US006079246A

United States Patent [19]

Caporusso et al.

[11] Patent Number: 6,079,246

[45] Date of Patent: Jun. 27, 2000

[54] UNIVERSAL MACHINE FOR BENDING PIPES OR SECTION BARS TO BOTH FIXED AND VARIABLE CURVATURES

[75] Inventors: Alessandro Caporusso; Mario Caporusso, both of Frosinone; Stefano Ramandi, Ceccano; Rossano Ramandi, Ripi, all of Italy

[73] Assignee: C.M.L. Costruzioni Meccaniche Liri S.r.l., Piedimonte San Germano, Italy

[21] Appl. No.: 09/141,748

[22] Filed: Aug. 28, 1998

[30] Foreign Application Priority Data

Aug. 29, 1997 [IT] Italy ..... RM97A0520

[51] Int. Cl.[7] ..... B21D 5/14; B21D 7/04

[52] U.S. Cl. ..... 72/173; 72/157

[58] Field of Search ..... 72/173, 171, 175, 72/157, 152, 149

[56] References Cited

U.S. PATENT DOCUMENTS

| | | | |
|---|---|---|---|
| 1,942,992 | 1/1934 | Yates | 72/171 |
| 2,895,531 | 7/1959 | Hauf | 72/175 |
| 5,431,035 | 7/1995 | Sheen | 72/173 |
| 5,704,242 | 1/1998 | Caporusso | 72/173 |

*Primary Examiner*—Daniel C. Crane
*Attorney, Agent, or Firm*—Young & Thompson

[57] ABSTRACT

Machine for bending pipes or section bars comprising a work table on which two or more powered spindle noses appear, at least one of which is powered to rotate in a direction and at least another is idle or driven to rotate in the opposite direction to the former one; said spindle noses being accessible for mounting/demounting on/from them spindles designed to support respective bender rollers or matrices defining a work area on the work table in order to bend a pipe or a section bar according to fixed or variable radiuses: support means for a counteracting member designed to co-operate with said bender rollers or matrices in a bending operation according to fixed or variable radiuses; said support means being firmly locatable on straight guide means in said work table along an approachment/removal direction of said counteracting member to/from, said work area.

13 Claims, 25 Drawing Sheets

UNIVERSAL MACHINE FOR BENDING PIPES OR SECTION BARS TO BOTH FIXED AND VARIABLE CURVATURES

BACKGROUND OF THE INVENTION

Description of the Related Art

This invention relates to the field of the machines for bending pipes or section bars.

Machines for bending pipes and section bars are mainly of two types: i) bending machines or roller benders having a variable bending radius, which are able to give a pipe or a section bar a spatial torsional deformation, i.e. a helicoidal pitch, in addition to a curvature in one plane; ii) pipe benders having a fixed bending radius, which are adapted to give a pipe or a section bar only a bending in one plane.

The possibility of changing a bending radius is critical for bending machines or roller benders, as it enables to have variable distances between the axes of the bender rollers.

In this connexion a symmetrical swinging system, an asymmetrical rectilinear system and a pyramidal system are known in the field of the bending machines.

The symmetrical swinging system is shown by way of example in FIG. 1 of the accompanying drawings. There is a work table 1 on which three grooved-pulley bender rollers 2, 3, and 4 are arranged in an isosceles triangle configuration. The two rollers 3 and 4, which are located in a base of the isosceles triangle configuration, can swing in slots 3' and 4', respectively, being driven by hydraulic cylinders 3" and 4". Two pressure rolls 5, 6 in the shape of elongated cylinders, which are able to give a pipe a helicoidal pitch, are mounted near two oblique sides around pivots 5' and 6' respectively at an end approaching a vertex of the isosceles triangle configuration opposite to said base so that the pressure rolls 5, 6 can be positioned angularly.

Three bender rollers are provided also in the asymmetrical rectilinear system, with two of them being on one side defining a work area and the third one being approachable/removable along a rectilinear guide to/from this work area.

In the pyramidal system two lower bender rollers are fixed and a third bender roller can be positioned rectilinearly above the two fixed bender rollers.

The same Applicant discloses how to achieve variable distances between the axes of bender rollers in his Italian Patent Application No. RM95A000309 filed on May 12, 1995, which is entitled "Universal Bending Machine". He claims a bending machine comprising a motor and reduction gear unit; a machine box, whose work table provides two or more pairs of hollow rotary drives having fixed parallel axes of rotation, which are designed to receive firmly in their cavity in a interchangeable way rotating roller spindles driven by the motor and reduction gear unit through gears arranged in the machine box, and a slider which is movable along a guide provided through the machine box on the same surface of the rotary drives, said slider passing through the fixed distance between the axes of said pairs of hollow rotary drives and supporting one or more roller spindles.

Advantageously such a bending machine is very stiff and allows that the distance between the axes can be changed very widely; further it is more simple and ergonomic, particularly as it is two-faced, than the abovesaid conventional machines.

SUMMARY OF THE INVENTION

This invention is based on the consideration that it would be very advantageous to have a machine both operating as a roller bender or bending machine and a normal pipe bender of the pulley type with a fixed radius, whether it has a spindle or a filling core or not.

Then, it is an object of this invention to provide a machine for bending pipes and section bars, both operating as a bending machine and a pipe bender, so called universal in virtue of the variability of the distance between the axes of the bender rollers.

This object is achieved by a machine having a work table, on which at least three powered spindle noses suitably arranged on the work table appear, and a support which can be firmly positioned rectilinearly toward/from a work area defined by these spindle noses.

Therefore, it is an object of this invention a machine for bending pipes or section bars comprising a work table on which two or more powered spindle noses appear, at least one of which is powered to rotate in a direction and at least another is idle or driven to rotate in the opposite direction to the former one; said spindle noses being accessible for mounting/demounting on/from them spindles designed to support respective bender rollers or matrices defining a work area on the work table in order to bend a pipe or a section bar according to fixed or variable radiuses;

support means for a counteracting member designed to co-operate with said bender rollers or matrices in a bending operation according to fixed or variable radiuses; said support means being firmly locatable on straight guide means in said work table along an approachment/removal direction of said counteracting member to/from said work area.

In the machine for bending pipes or section bars according to the invention said support means for a counteracting member comprises a slider firmly locatable along said guide, and a bracket provided with mounting means of a bender roller in an adjustable position transversally to the movement of the slider along the guide thereof.

Said mounting means of a bender roller on said bracket comprises a plurality of holes obtained in the same bracket along a line transversal to the movements of approachment/removal to/from the work area of said slider.

Alternatively, said mounting means of a bender roller on said bracket comprises in said bracket a slot that is transversal to the movements of approachment/removal of said slider to/from the work area.

Moreover, it is an object of this invention a machine for bending pipes or section bars further characterized in that said bracket is mounted swinging on said slider; its swing being controlled by a lever arm pivoted toward an end thereof on the same bracket, and by means of its opposite end on the work table, in order to change continuously a distance between the axes of the bender roller mounted on the bracket and a roller mounted on a sprindle nose, that in a bending operation is internal to a pipe o section bar to be worked, the bender roller mounted on the bracket being external.

Said lever arm has a number of holes toward an end thereof for its pivoting with said bracket.

Alternatively, said lever arm has a slot toward an end thereof for its pivoting with said bracket with a micrometer adjustment of the positioning.

Moreover, it is an object of this invention a machine for bending pipes or section bars further characterized in that it comprises support means of a pressure roll, that is pivoted about an axis of rotation of a bender roller mounted on a spindle nose that, in a bending operation of a pipe or section bar is internal to the latter, a bender roller mounted on said support means for a counteracting member being external, the pipe or section bar reaching said pressure roller from the guide of these two bender rollers; and said support means of pressure roll being pivoted to said bracket by a small arm including adjustable pivoting means along a length dimension thereof.

Said support means of pressure roll includes adjustable pivoting means along a direction parallel to the axis of a pressure roll mounted thereon by said small arm.

In particular, said adjustable pivoting means is a line of holes.

Alternatively said adjustable pivoting means is a slot.

Moreover, it is an object of this invention a machine for bending pipes or section bars comprising an electric motor to power said spindle noses; an operating cylinder to approach/remove said support means of counteracting member, and an electric motor to operate said cylinder.

It is also an object of this invention a machine for bending pipes or section bars comprising a microprocessing control unit operatively connected to said electrical motors; an inverter operatively connected to said electrical motor and to a power source as well as to said microprocessing control unit; a control keyboard blanked to said control unit; a display blanked to said control unit; detecting and encoding means of the position of said support means of counteracting member and detecting and encoding means of the angular position and the rotation speed of at least a spindle nose; said microprocessing control unit being programmed to control a bending operation of a pipe or section bar according to a fixed radius or a variable radius through the control of said spindle noses and said cylinder.

Said microprocessing control unit is programmed to control automatically through said inverter the rotation speed of said electric motor powering said spindle noses and said bender rollers according to a torque required to bend a pipe or section bar, optimizing working cost and time.

Moreover, such a machine for bending pipes or section bars further comprises microswitches and solenoid valves to bend in a plane a pipe with a core or spindle operatively connected to said microprocessing control unit being further programmed to control a bending operation of a pipe with core; said microprocessing control unit driving the retraction of the core before the end of the curve in order to avoid a core impression on the pipe visible from the outside of the same pipe, while a fixed radius bending matrix, that is mounted on one of said spindle axes, continues its rotation up its stop.

Moreover, such a machine for bending pipes or section bars further comprises detecting means of the longitudinal feeding of a pipe or section bar in a bending operation, said microprocessing control unit being programmed to control both the linear position of a third deformation roller—which is mounted as a counteracting member on said support means of counteracting member for a bending operation—by means of said cylinder and the feeding of the pipe or section bar, thus permitting the construction of geometrical figures formed by arches and straight lines automatically without removing the pipe or section bar.

In particular, in the machine for bending pipes or section bars according to this invention said microprocessing control unit tests the network line voltage for the spindle nose motor, adjusting the voltage on the electrical motor so that it is between 195 and 200 Vac.

Advantageously such a machine for bending pipes or section bars comprises a spindle nose unit that is mountable/demountable on/from said work table, including one or more additional spindle noses, and transmission means of rotatory motion adapt to transmit the rotatory motion of a spindle nose appearing on said work table to said one or more additional spindle noses.

According to a preferred embodiment of the invention a machine for bending pipes or section bars comprises three powered spindle noses appearing on said work table, one of which is directly powered and rotating in a direction, the other two rotating in another direction being driven through transmission means of the rotatory motion by the directly powered spindle nose, the rotatory motion to them being transmitted geared down.

This invention offers the following advantages.

The roller-holder spindles are interchangeable quickly without removing any structural portion of the machine, as the machine is previously arranged to receive the interchangeable spindles in all abovementioned configurations. This is a development of the state-of-art machines, that are sold with spindles of a kind as previously required by a buyer, i.e. normal, short, long or specially shaped spindles.

The machine according to the invention performes the task of bending pipes and section bars to both fixed and variable curvatures, it allows an operator to change the distance between the axes of the spindles as well as to replace spindles with others of different length and/or shape. The machine further permits that the pressure roll changes automatically its angular position with respect to a pipe or a section bar to be bent by an arrangement always orthogonal to the latter, since the position of the pipe being bent to a variable curvature changes continuously as the curve is performed during a number of passes until a desired bending radius is obtained. Eventually, when the machine according to the invention is operating with a variable bending radius, it is allowed to bend by feeding the bender roller both with a straight-line motion or a straight-line swinging motion. All the set forth conditions are required by the operator of the field.

BRIEF DESCRIPTION OF THE DRAWINGS

This invention will be best understood from the following detailed description of its preferred embodiments, made only by example but not in limiting way, with reference to the accompanying drawings, in which:

FIGS. 8A, 8B, 8C, 8D, 8E, 8F, 8G, 8H, and 8I illustrate the electric diagram of an inverter included in the control electronics, and FIGS. 9A, 9B, 9C, 9D, 9E, 9F, 9G, 9H, and 9I illustrate the electric diagram of a microprocessing control unit included in the control electronics.

DESCRIPTION OF THE PREFERRED EMBODIMENTS

Figure 1:
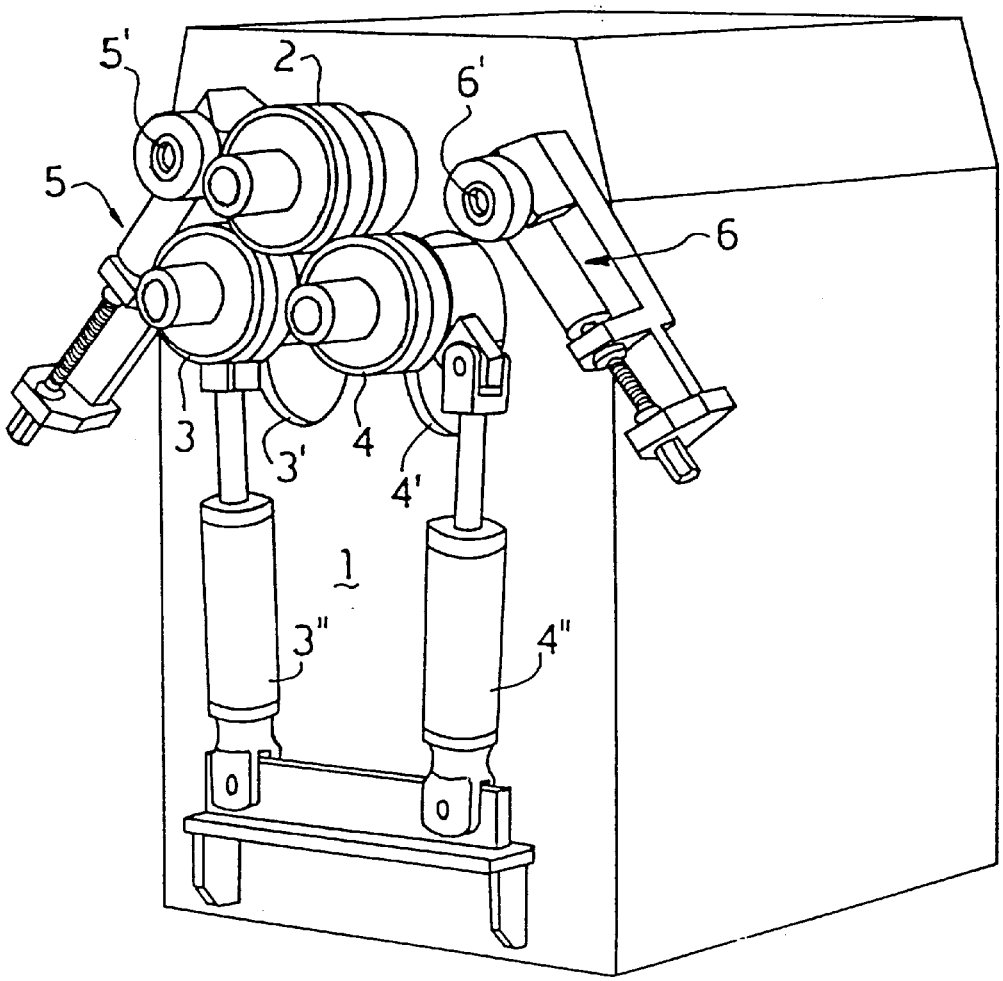
FIG. 1 is a perspective view showing an illustrative prior art bending machine.
Figure 2:
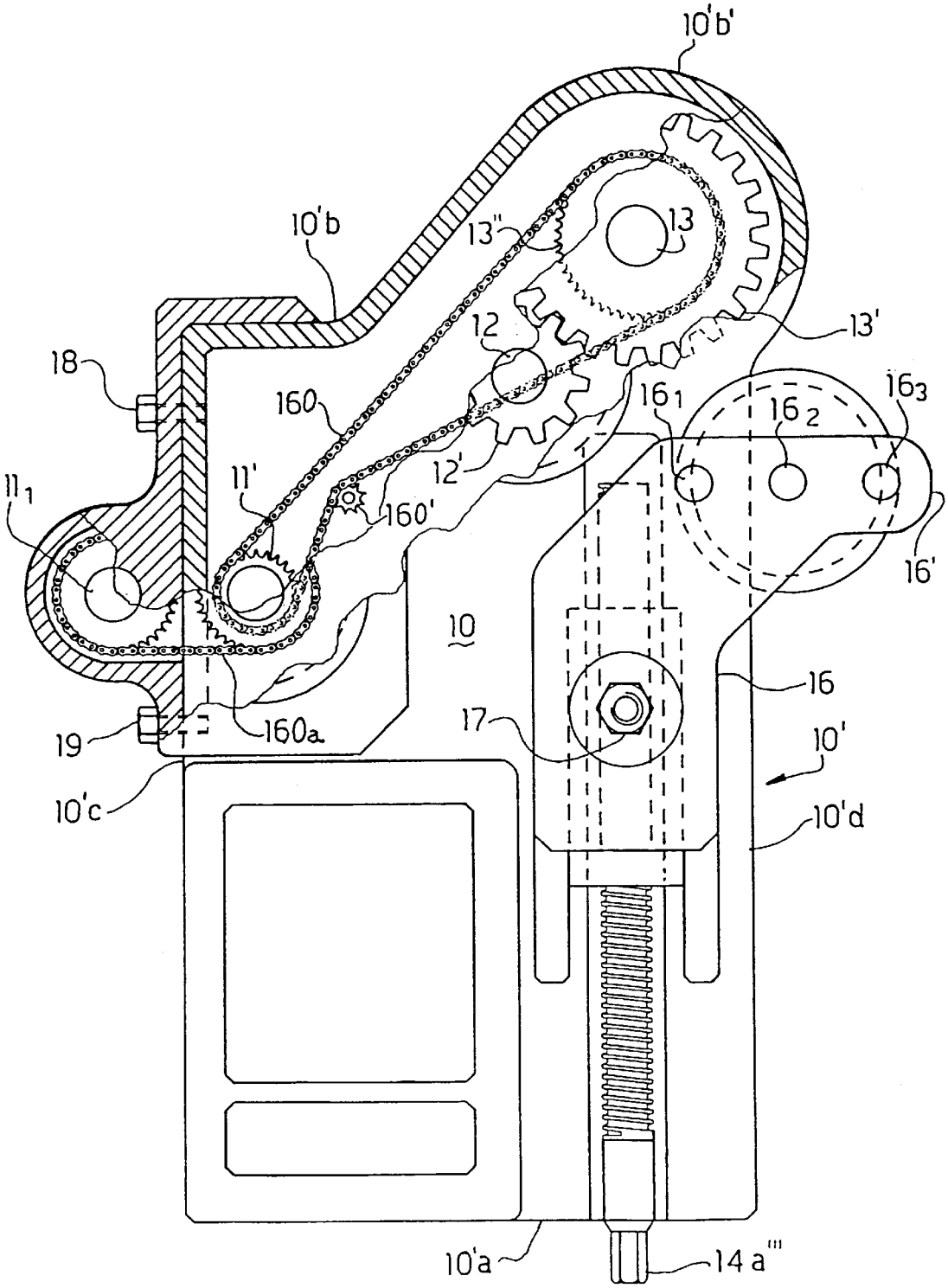
FIG. 2 is a top view of a machine according to the present invention, with partial cutouts on three levels of depth from the work table of the machine, in order to show the motorization thereof.

As shown in FIG. 2 a machine for bending pipes and section bars according to this invention provides a horizontal work table 10 as a top of a machine body 10'. The machine body 10', being of generally rectangular plan dimensions, has a frontal side or, shortly, front 10'*a* of the machine near to an operator, a head side 10'*b* far from the operator, and two lateral sides 10'*c* and 10'*d*.

Very near the work table 10, powered spindle noses appear on which pulling bender rollers and a grooved pulley matrix with shoulder can be mounted by means of roller-holder spindles in order to bending or curving pipes and section bars.

Figure 4:
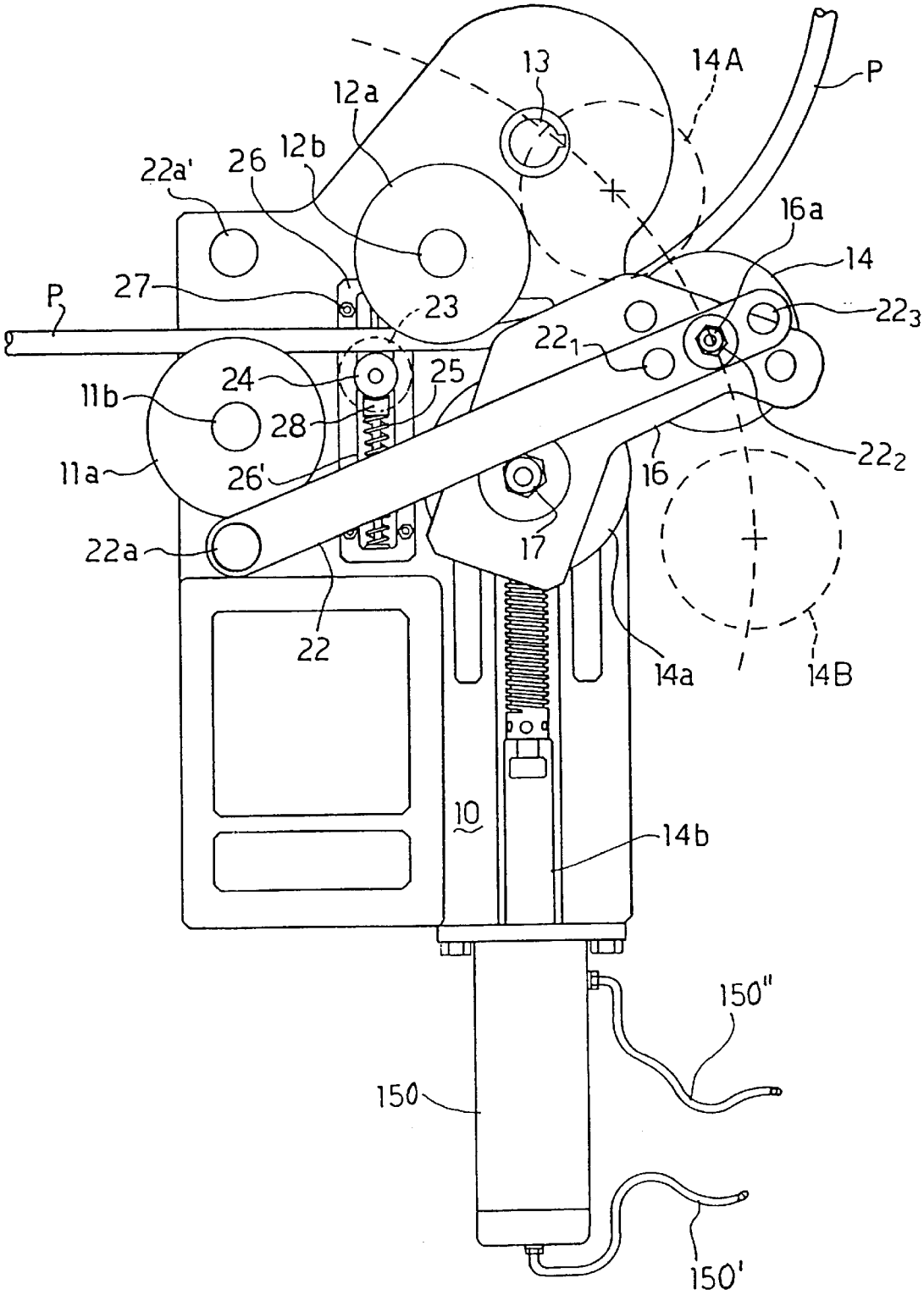
FIG. 4 is a top view of a machine according to the present invention, shown as a bending machine, illustrating a mounting swinging arrangement of a bracket holding a deformation roller as teached by the present invention.
Figure 6:
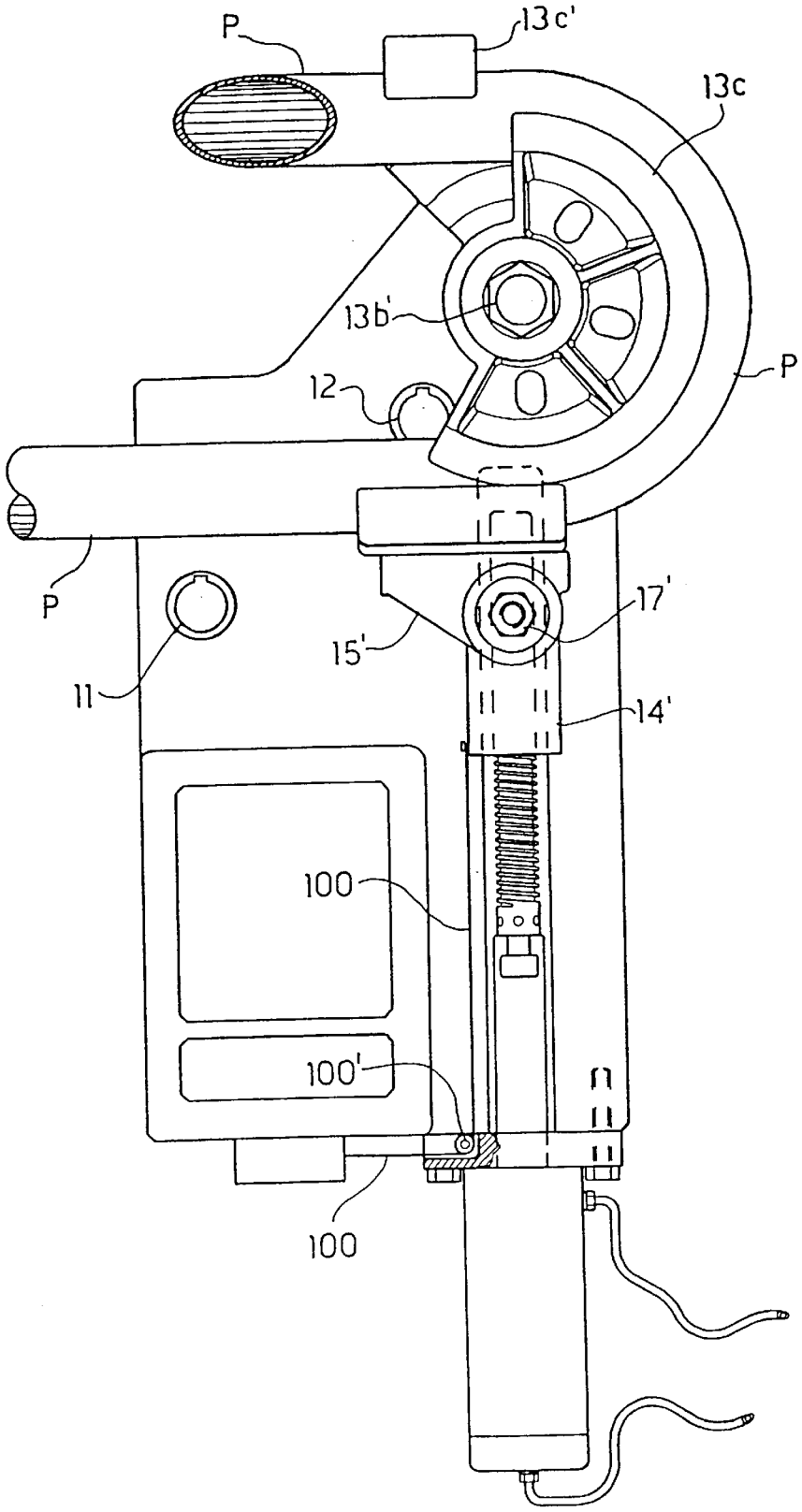
FIG. 6 is a top view of a machine according to the present invention, shown as a normal fixed-radius pipe bender or section bar bender, operating counterclockwise.

According to a basic configuration, as shown in FIGS. 6 and 4, three spindle noses 11, 12, and 13 are arranged on the work table 10 in diminishing order in height from left hand lateral side (for an operator on the front 10'*a*) to the right hand lateral side and toward the head side 10'*b*. The last spindle nose 13 appears on a shelft 10'*b'* projecting diagonally in a corner from the head slide 10'*b* and the right lateral side 10'*d*.

Figure 3:
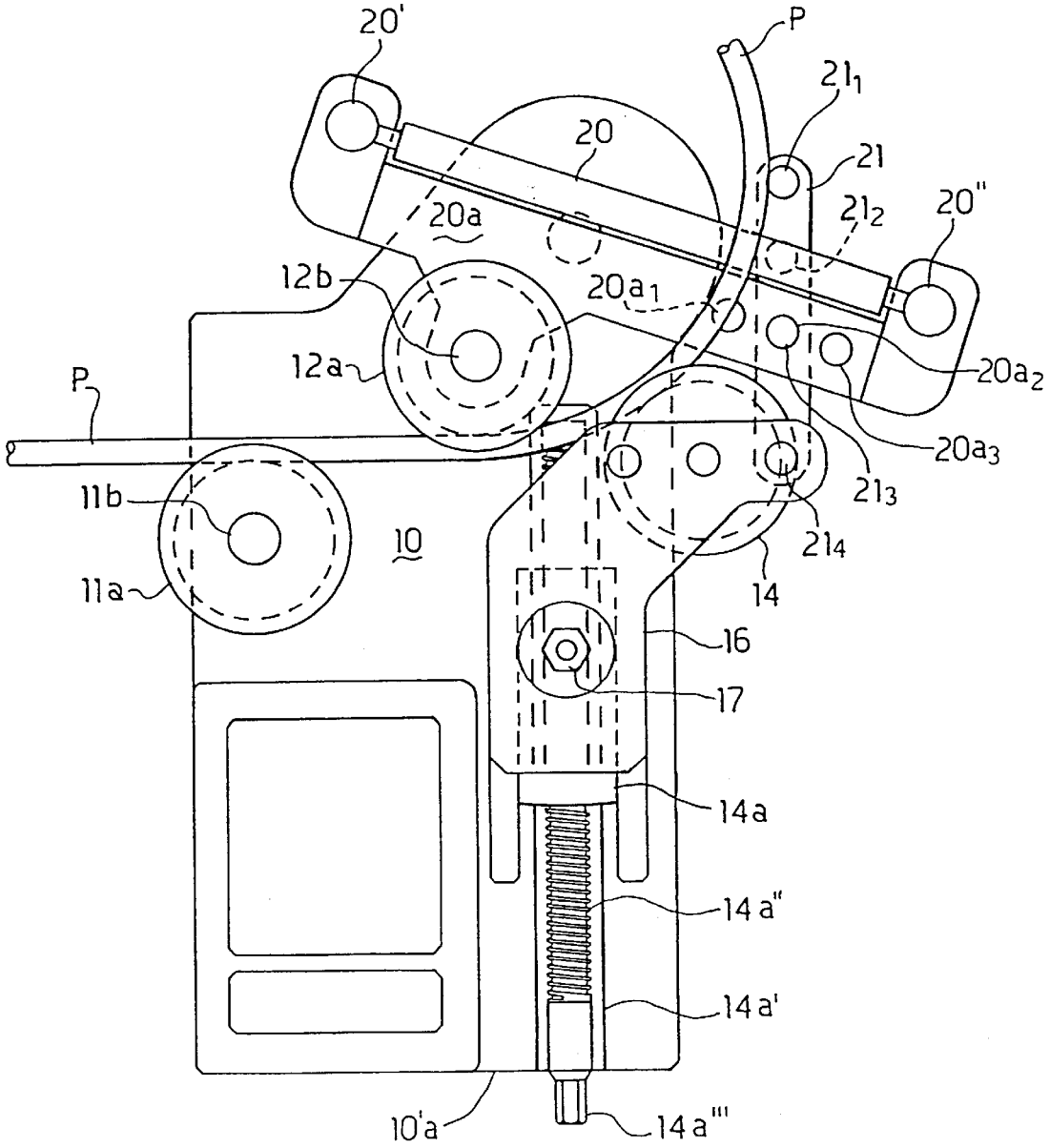
FIG. 3 is a top view of a machine according to the present invention, shown as a bending machine or roller bender, illustrating a mounting arrangement for a pressure roll as teached by the present invention.
Figure 5:
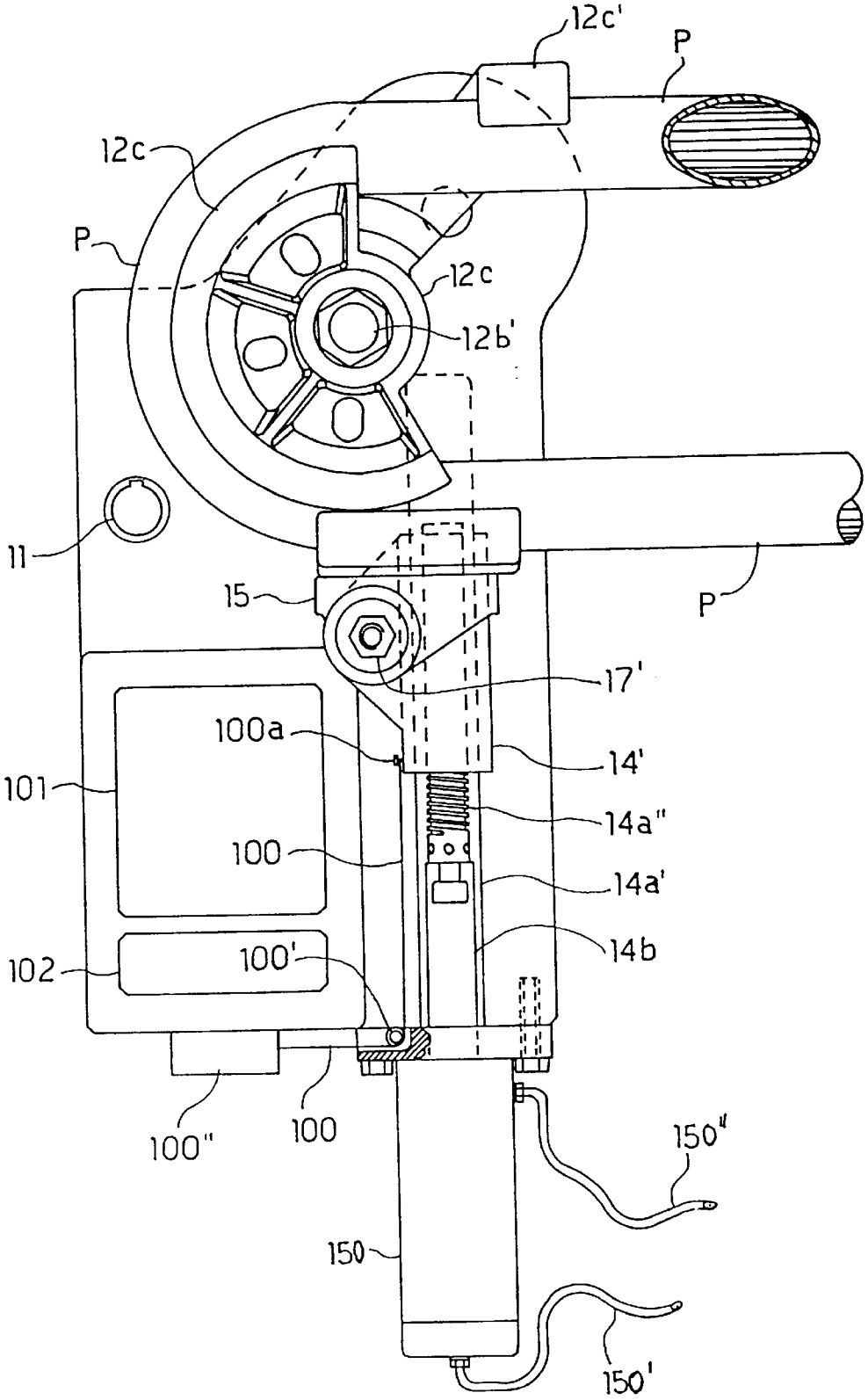
FIG. 5 is a top view of a machine according to the present invention, shown as a normal fixed-radius pipe bender or section bar bender, operating clockwise.

The spindle noses define a work area on the work table, where, as shown in FIG. 3 and FIG. 4, two pulling bender rollers 11*a* and 12*a* are arranged on spindle noses 11 and 12, respectively or, as shown in FIG. 5 and FIG. 6, a grooved pulley matrix 12*c* or 13*c* is arranged on a spindle nose 12 or 13, respectively, by means of matrix-holder spindles 13*b'*, 12*b'*. Thus, all above mentioned bending members are powered by the spindle noses.

Said diminishing order in height between the first spindle nose 11 and the second spindle nose 12 is such that, according to the diameters of the bender rollers to be mounted on the spindle noses, as shown in FIG. 3 or 4, the bender rollers 11*a* and 12*a* can engage an external surface of a pipe P or similar—correspondingly with suitably spaced sections thereof—the bender roller 11*a* being on the one side of the pipe P or similar, the bender roller 12*a* being on the other side of the same. The bender rollers 11*a* and 12*a* pull the pipe P to be worked in a feeding direction against a third roller or deformation roller 14, working on the same side of the first roller 11*a*, as shown in FIG. 3 and FIG. 4. The third roller 14 is brought near the work area to a suitable position with respect to the pulling rollers for a bending o rolling operation. After this operation, the third roller 14 is moved away to clear the work area.

This third roller 14 is mounted on a slider 14*a* that is firmly locatable along a longitudinal straight guide 14*a'* on the work table 10. The straight guide 14*a'* is suitably offset toward the right hand lateral side with respect to the first and second spindle nose 11 and 12.

A similar slider supporting a countermatrix 15 is also designed to be arranged firmly locatable in this straight guide 14*a'*. The countermatrix 15 is designed to co-operate with the matrix 12*c* or 13*c* in a curving operation with a pulling shoulder 12*c'*, 13*c'* that is integral with the matrices 12*c* and 13*c* respectively.

The slider 14*a* or 14', as shown in FIGS. 2 and 3 is positioned by a screw 14", that is hand-operated through its hexagonal head projecting from the front 10'*a* or, alternatively, as shown in FIGS. 4, 5 and 6, is driven by a piston rod 14*b* of a hydraulic cylinder 150 with forward and backward stroke hydraulic pipes 150' and 150" respectively.

The slider positioning can be controlled by an electronic system. This system comprises a microprocessor 101, a display 102 and a pulse counter or encoder 100". The pulse counter 100" receives pulses from a wire 100, which is connected at one end to the pulse counter and at the other end to the slider 14' by a pin 100*a*. The wire 100 is made parallel to the direction of movement of the slider by a pulley 100'.

FIG. 2 shows as an example how the spindle noses can be driven. Only the second spindle nose 12 is directly powered by an electric motor (not shown). Rotating integral with the spindle nose 12 is a gear 12' which engages another gear 13' arranged on the shelf 10'*b'* which rotates the spindle nose 13. Mounted on a lower level with respect to gears 12', 13' is a block chain 160 for the transmission of the rotary motion of the spindle nose 13 to the spindle nose 11. The block chain 160 engages a sprocket wheel 13" rotating integral with the gear 13', and a sprocket wheel 11' integral with the spindle nose 11. A loop is formed by the block chain 160 passing on the sprocket wheel 13" on the one hand and on the sprocket wheel 11' on the other hand. A length of this loop facing the front 10'*a*is stretched by a chain stretcher wheel 160'.

The driven spindle nose 13 rotates counterclockwise to the drive spindle nose 12, as the latter transmits its rotary motion by a gear. The spindle nose 11 rotates in the same direction of the spindle nose 13, as the latter transmits its rotary motion by a chain.

When the machine according to this invention operates both as a bending machine or a roller bender, the second spindle nose 12 is driven counterclockwise. Thus the first spindle nose 11 rotates clockwise. The bender rollers mounted on the spindle noses can work together in pulling a pipe or section bar P in a feeding motion from left hand to right hand during a bending operation.

When the machine according to this invention operates as a pipe bender having a fixed bending radius, the second spindle rose 12 is driven clockwise, that the third spindle nose 13 drives counterclockwise a pulley matrix mounted thereon, as shown in FIG. 6. or itself drinks clockwise a pulley matrix mounted thereon, as shown in FIG. 5.

The third roller 14 is mounted on the slider 14*a* by means of a roller-holder bracket 16. The bracket 16 is attached to the slider 14*a* by a pivot 17.

The roller-holder bracket 16 has a fork-shaped head portion 16' provided with a plurality of holes $\mathbf{16}_1$, $\mathbf{16}_2$, $\mathbf{16}_3$ to fit a third roller by a relative pin to a plurality of positions with respect to the first two rollers, with a variable distance between the axes from the first roller and the second roller. In lieu of the holes, e.g. a slot (not shown in the drawings) can be provided to permit an infinite change in the transversal position of the third roller, i.e. a continue change. The third roller as well as the piston rod could be powered and controlled by a microprocessor as shown in FIGS. 3 and 4.

In order to further increase the changeability of the distance between the axes, the machine according to the invention is provided with one or more additional pulling spindle noses, e.g. a spindle nose $\mathbf{11}_1$ as shown in FIG. 2, that are driven by a transmission chain 160*a*. The spindle nose $\mathbf{11}_1$ can be installed from the top on the work table 10, e.g. by means of four bolts, two of which, 18, 19, can be seen in FIG. 2.

FIG. 3 shows a universal machine according to the present invention operating both as a bending machine or a roller bender, which is equipped with a further preceptive attachment. This attachment consists of a pressure roll 20 pivoted at its ends 20', 20" to a swinging bracket 20*a*, which in turn is pivoted to the pulling spindle 12*b* under the pulling roller 12*a* on the work table 10. Further, the swinging bracket 20*a* is pivoted to the roller-holder bracket 16 by means of a small arm 21. The small arm 21 is provided with a plurality of holes $\mathbf{21}_1, \mathbf{21}_2, \mathbf{21}_3, \mathbf{21}_4$ so that a hole $\mathbf{21}_3$ is pivoted on a hole $\mathbf{20}a_2$ of another plurality of holes $\mathbf{20}a_1$, $\mathbf{20}a_2$, $\mathbf{20}a_3$ correspondingly provided on the swinging bracket and another hole $\mathbf{21}_4$ is pivoted on one hole of the plurality of holes of the roller-holder bracket 16. Thus, such a pressure roller 20 in a rolling operation as shown in FIG. 3 is arranged automatically at right angle to a pipe or a section bar P to be bended; this is the optimal position for the pressure roll.

FIG. 4 shows a universal bending machine according to the present invention operating according to variable radiuses with a further preceptive attachment.

The roller-holder bracket 16 is mounted on the slider 14*a* not fixedly, but rotating on the pivot 17.

Thus, the following three movements are allowed to the roller-holder bracket;

- a longitudinal movement, e.g. by means of a hydraulic cylinder 150, that enables the deformation roller 14 to be brought near to and to be moved from a pipe or section bar P to be bended;
- a transversal movement to change the distance between the axes of the bender rollers and the deformation roller 14 by securing the latter on one hole of two or more holes, e.g. three holes $\mathbf{16}_1$, $\mathbf{16}_2$, $\mathbf{16}_3$;
- a swinging movement; such a movement allows the bending machine to begin bending a pipe or a section bar with a variable distance between the axes of the spindle 12*b* and the shaft 16*a* supporting the third roller or deformation roller swinging between the one end position 14A and the other end position 14B. The swinging is controlled by a lever arm 22 pivoted on its end 22*a* on the work table 10 and toward the opposite end on the shaft 16*a* supporting the third roller 14 by a hole $\mathbf{22}_2$ of a plurality of holes, of which the lever arm 22 is provided, e.g. three holes $\mathbf{22}_1$, $\mathbf{22}_2$, $\mathbf{22}_3$.

In the embodiment illustrated in FIG. 4 the lever arm 22 is shown as pivoted on the work table in a position shifted from the spindle 11*b* toward the front of the machine. However, the lever arm 22 can be pivoted elsewhere on the work table, e.g. on another pivot 22*a'* provided toward the head side of the machine, beyond the first roller 11*a* as shown in FIG. 4, or also e.g. on the spindle of the first roller 11*a*. Thus the distance between the axes traversed by the bender roller is largely variable; the lever arm 22 functions also as a stiffener.

The three said movements, i.e. longitudinal, transversal and swinging movement, allow the bending machine to change the position of the third roller according to the work being carried out, thus making the bending machine adapt to bend pipes or section bars both to small or great bending radiuses apart from their sizes.

FIG. 5 and FIG. 6 show a universal bending machine according to the present invention operating with fixed radiuses, particularly as a fixed radius pipe-bender. The interchangeable spindle 12*b'* or 13*b'*, having a hexagonal-shaped cross-section, rotates a grooved pulley matrix 12*c* or 13*c*, having a fixed radius. The pipe P is engaged by said matrix as well as by a pulling shoulder 12*c'* or 13*c'* and a countermatrix 15 or 15' in a pipe-bender clockwise and in another pipe-bender counterclockwise shown in FIG. 5 and FIG. 6 respectively, as above mentioned, in a way well-known to the experts of the art.

As above mentioned, the countermatrix is mounted on the slider 14' firmly locatable along the straight guide 14*a'*. As shown in FIG. 5 and FIG. 6, the slider 14' is driven by a hydraulic cylinder. The slider 14' is mounted on the screw 14" in order to bring the same slider to a position changeable according to the radius of the grooved pulley matrix in use.

The angular position of the pulley matrix is controlled and displayed by a microprocessor 101.

Figure 7:
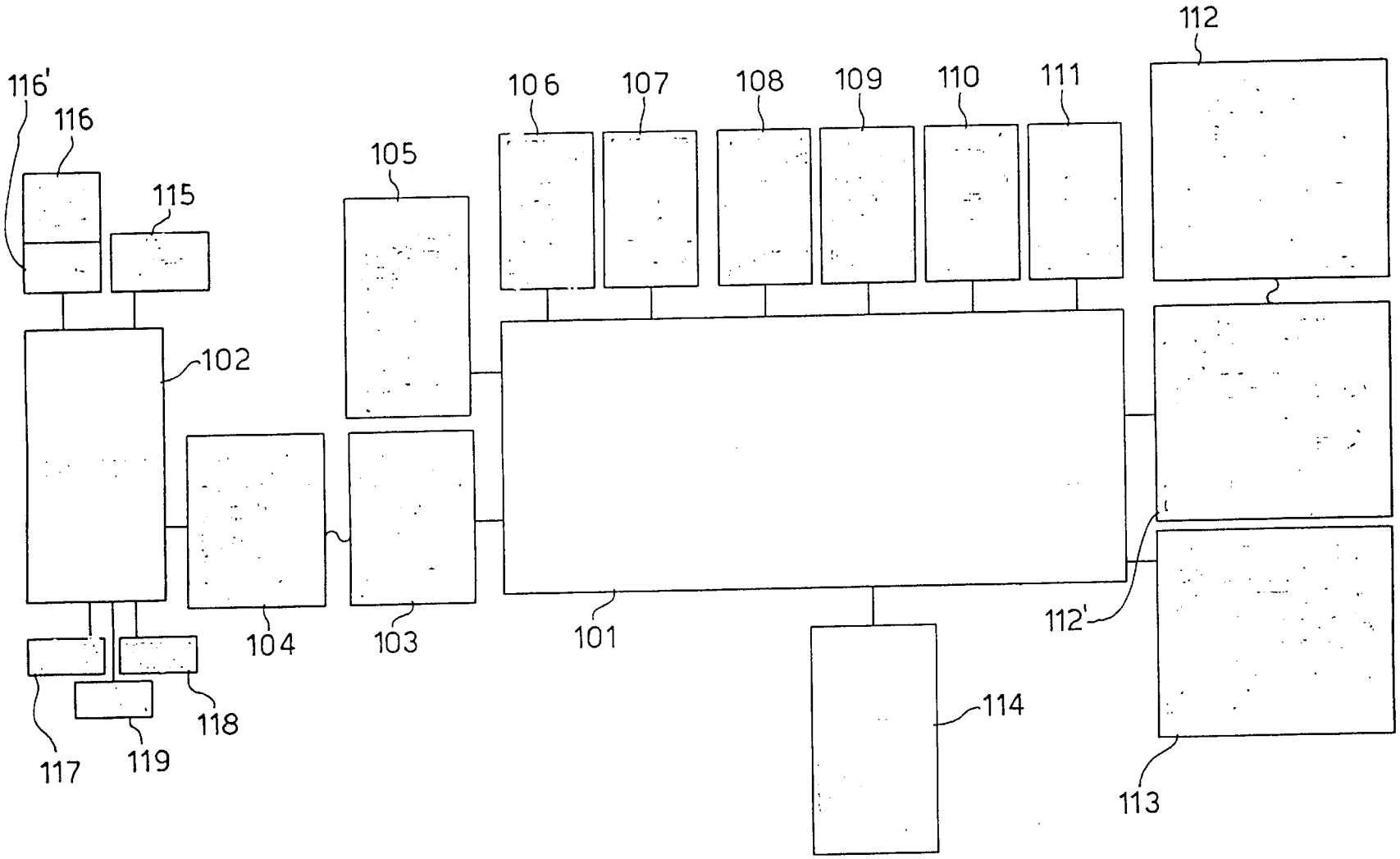
FIG. 7 is a block diagram of control electronics of a machine according to the present invention.
Figure 8A:
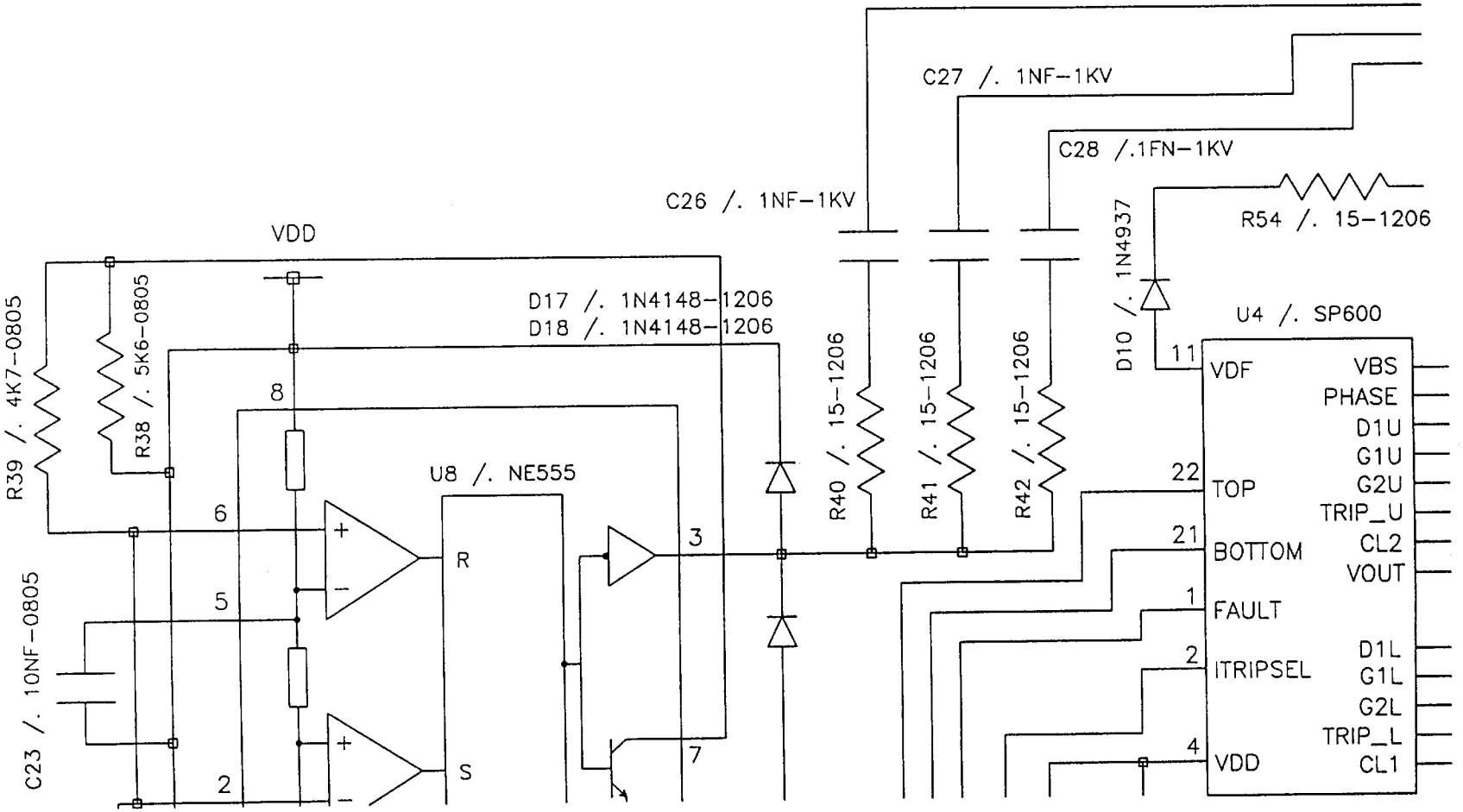
Figure 8B:
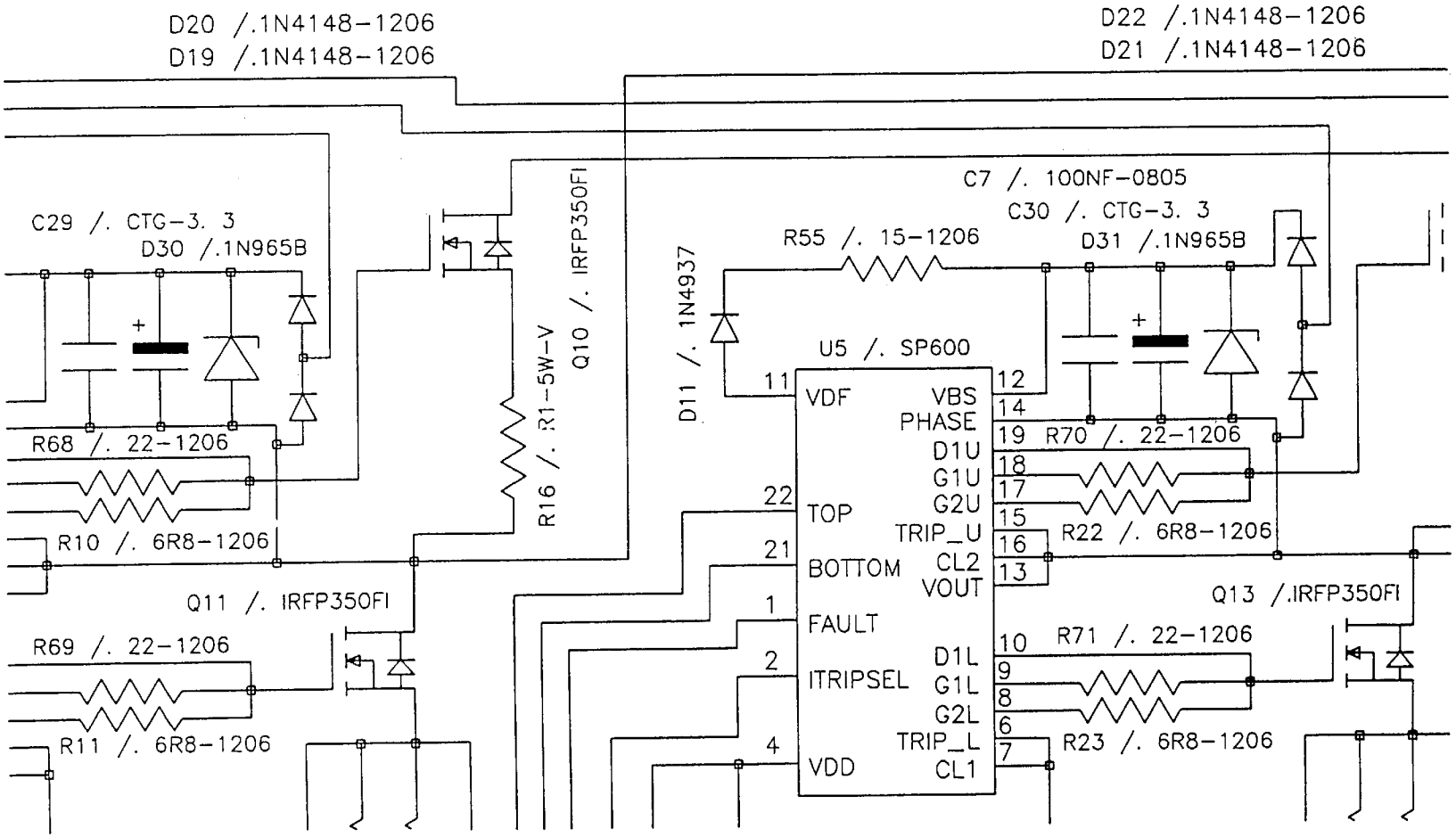
Figure 8C:
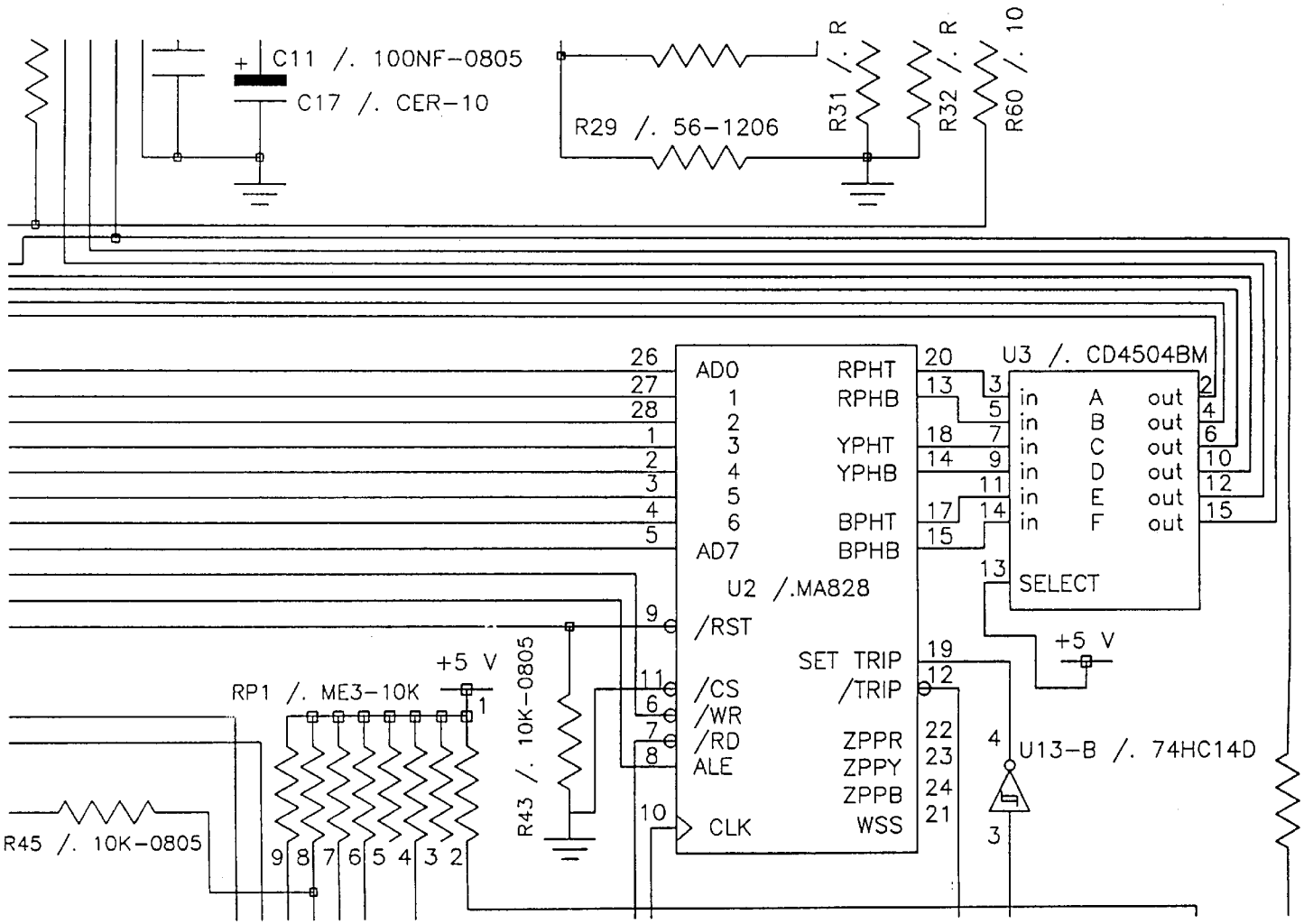
Figure 8D:
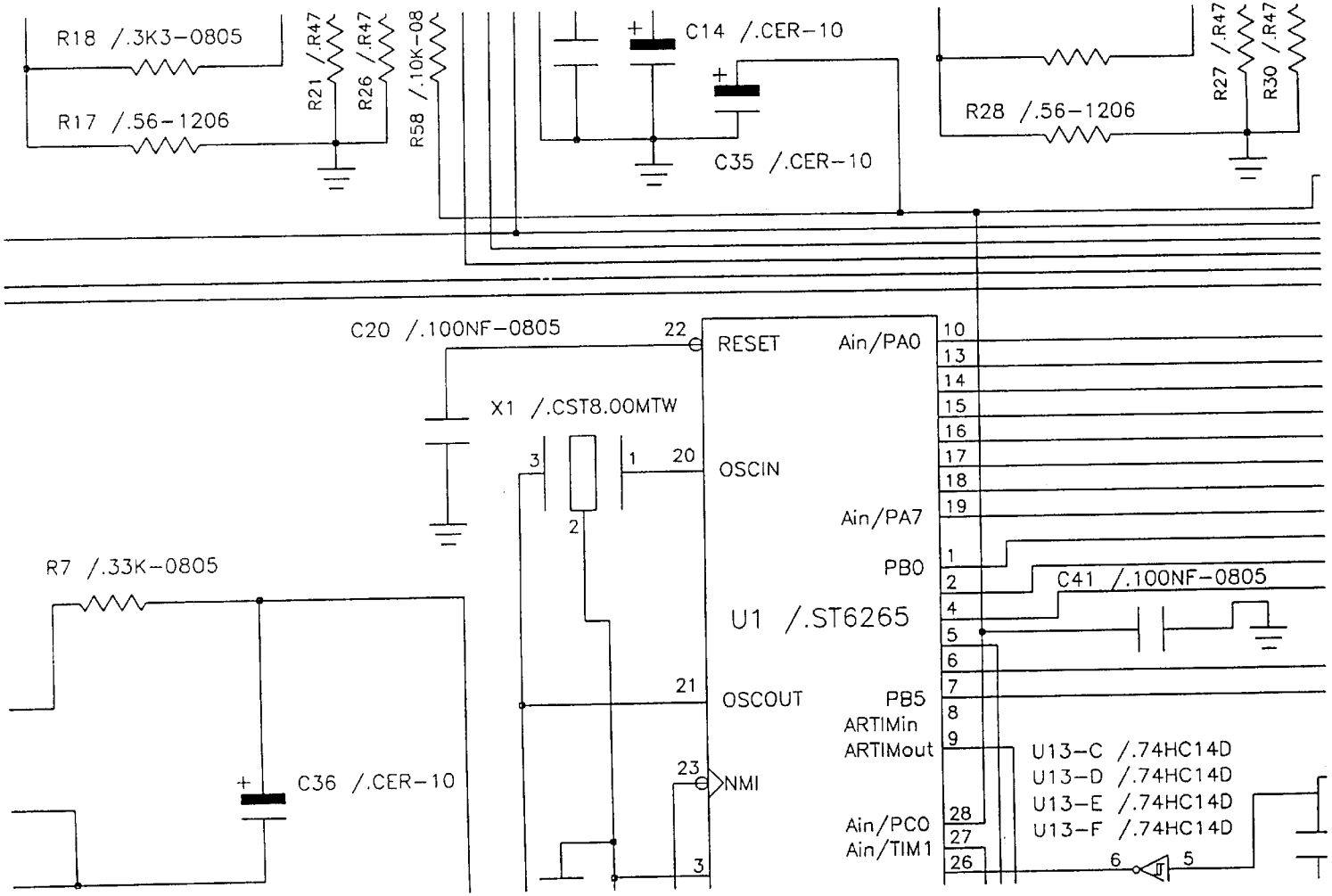
Figure 8E:
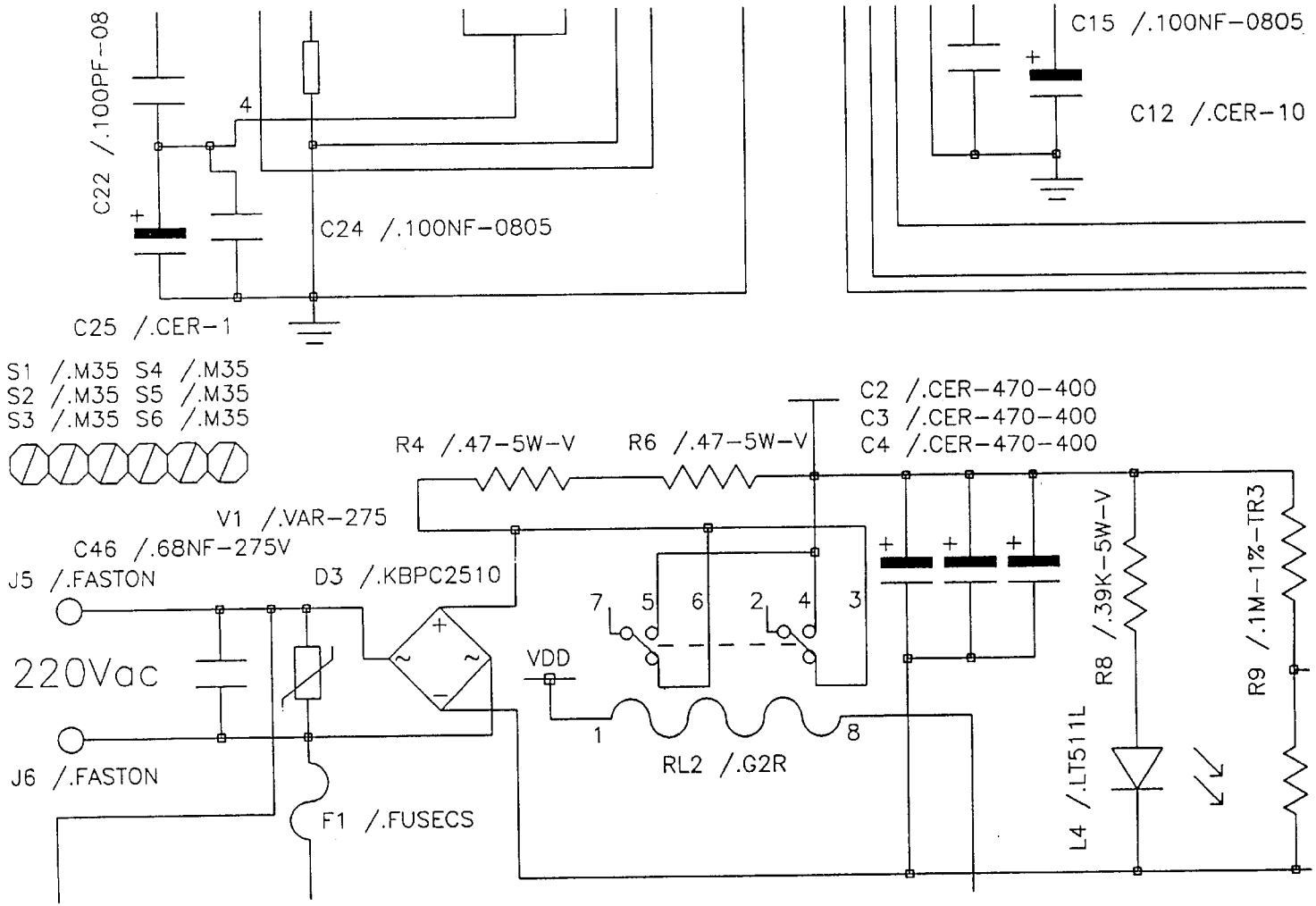
Figure 8F:
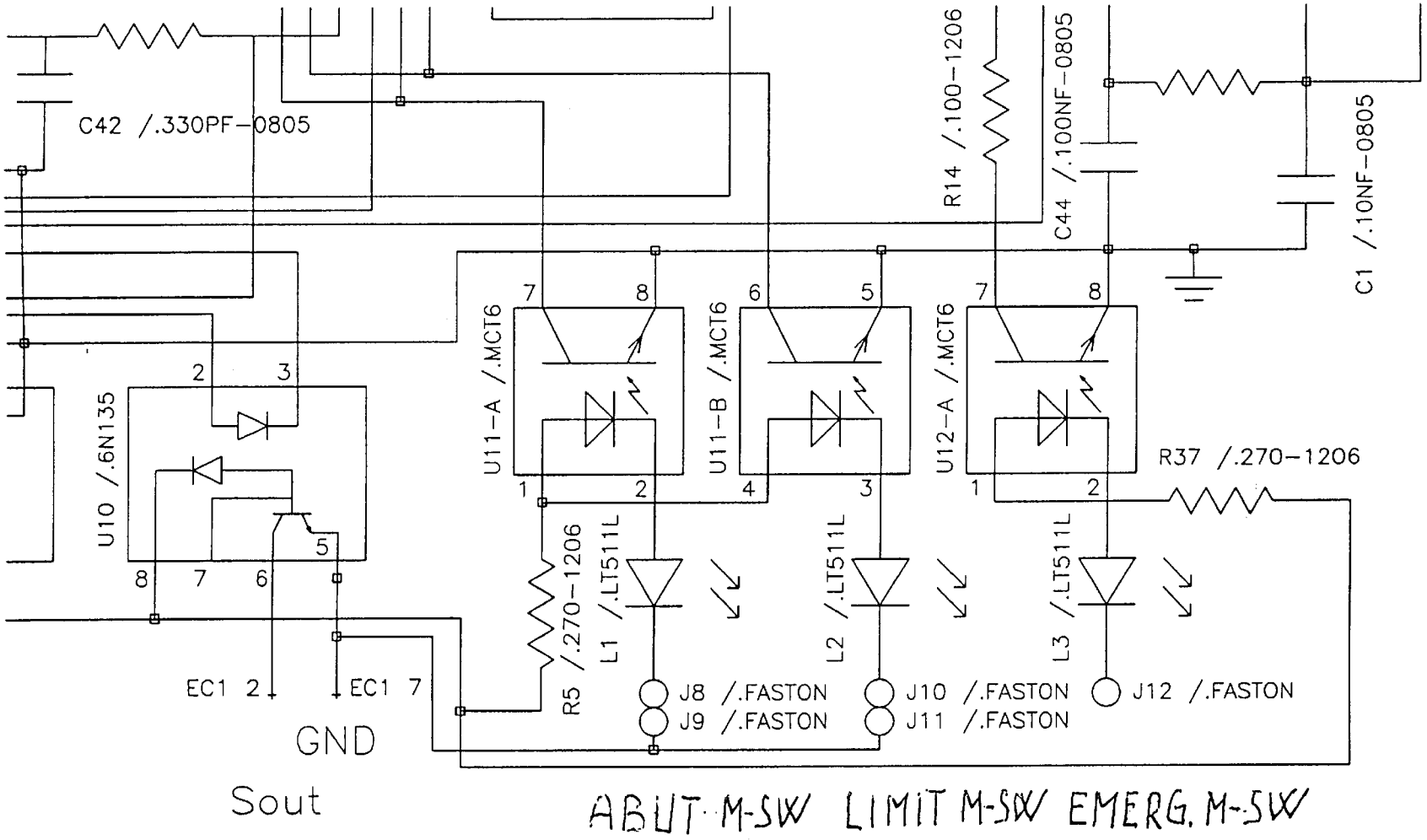
Figure 8G:
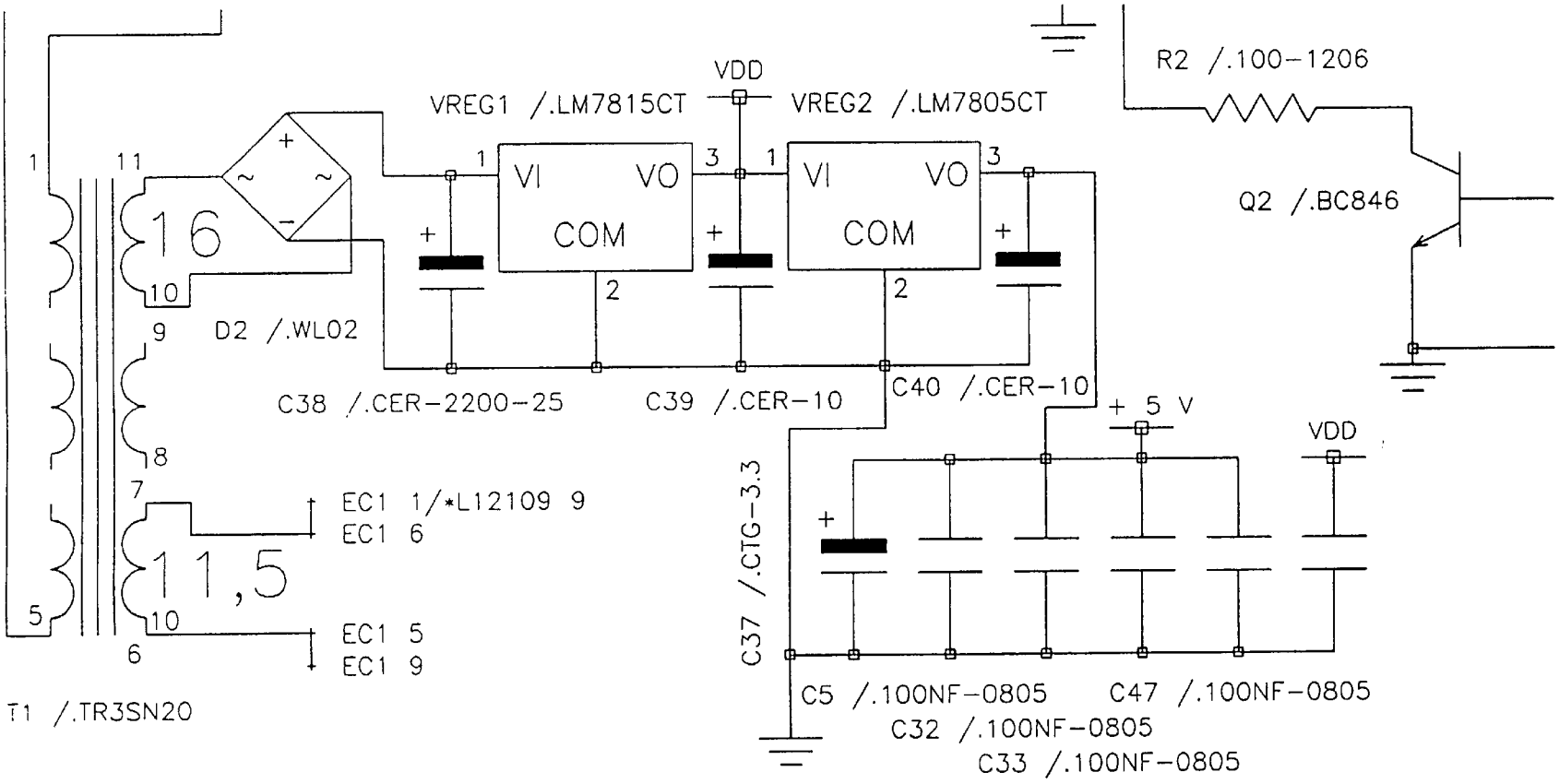
Figure 8H:
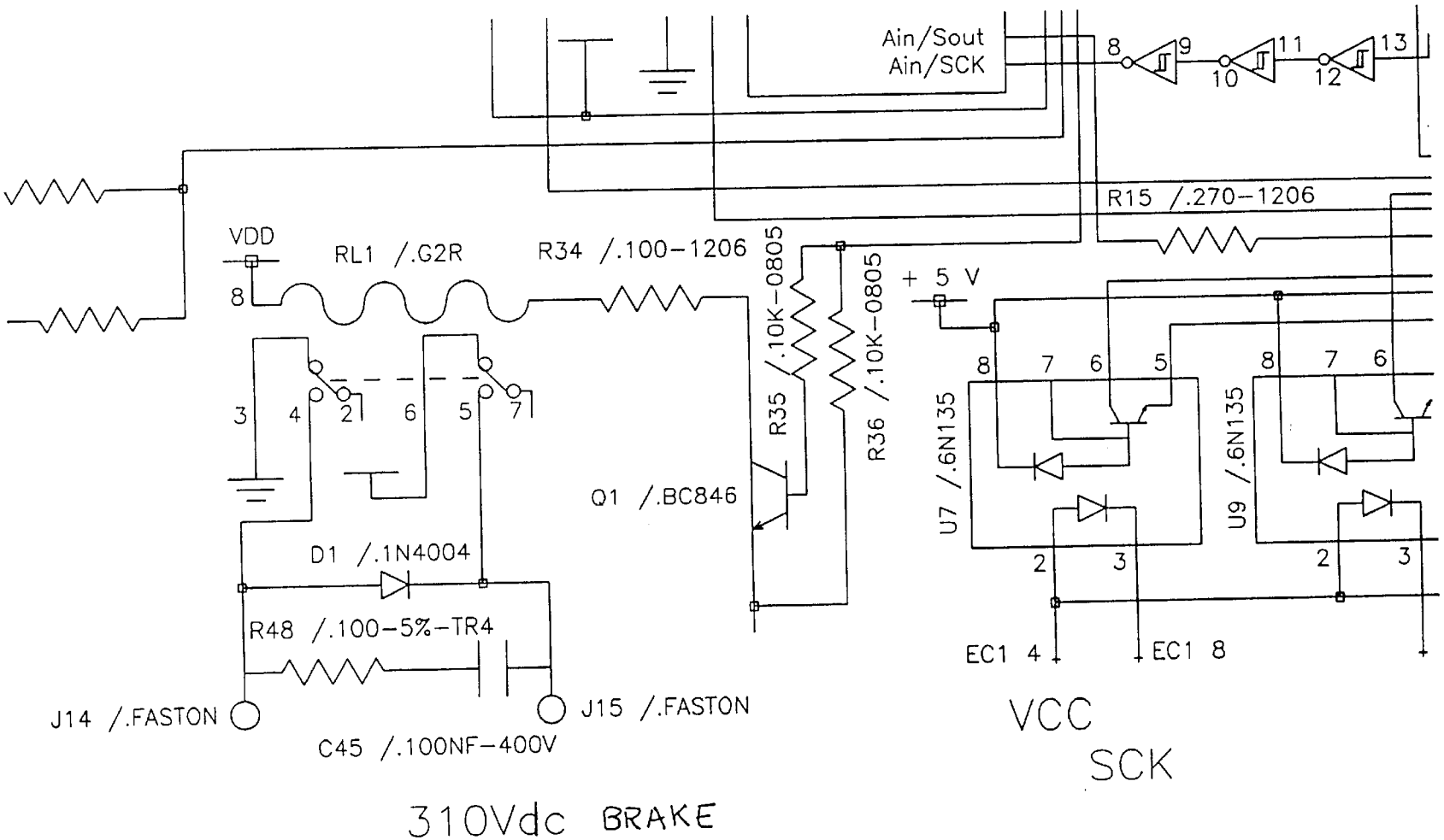
Figure 81:
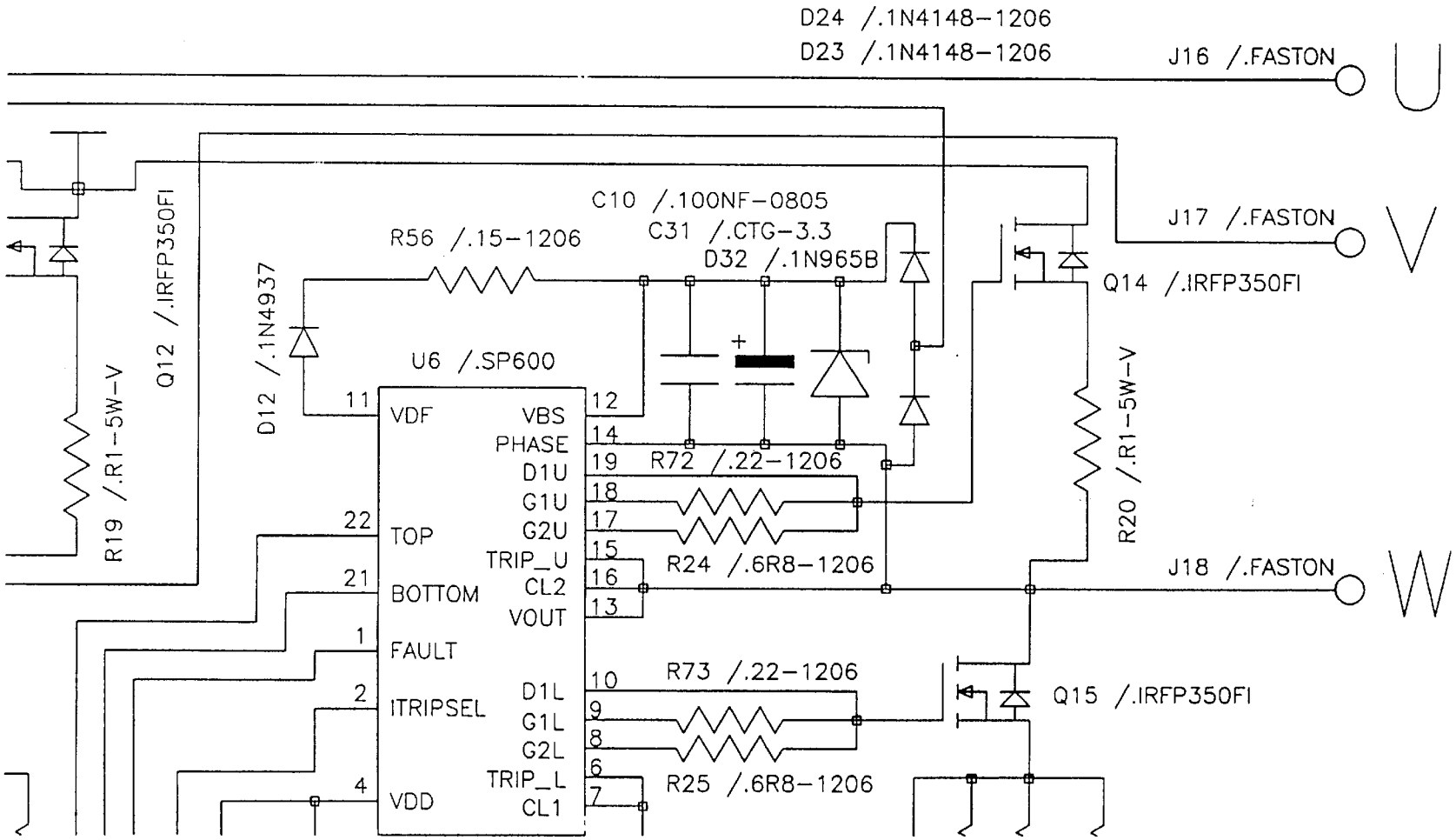
Figure 9A:
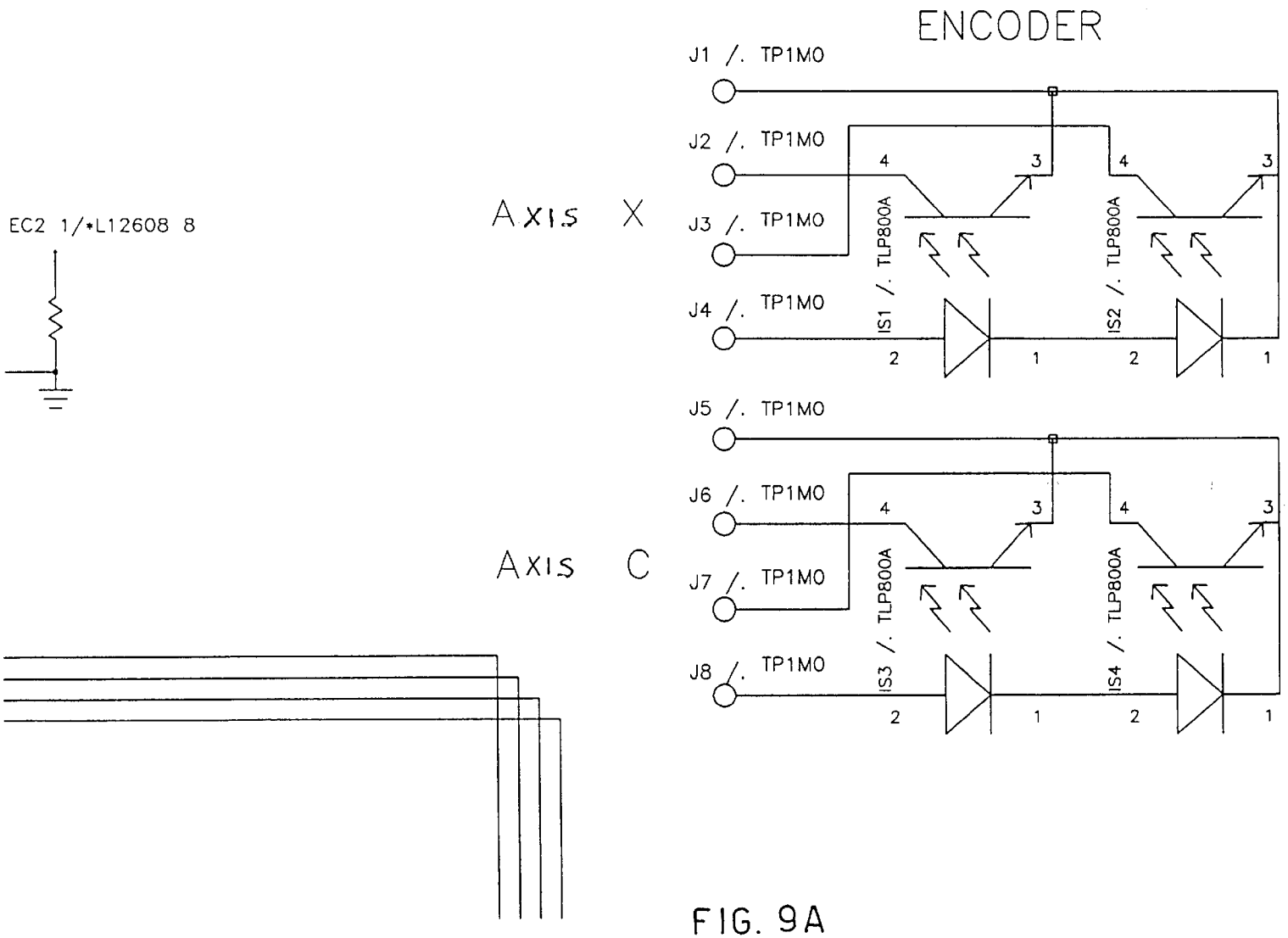
Figure 9B:
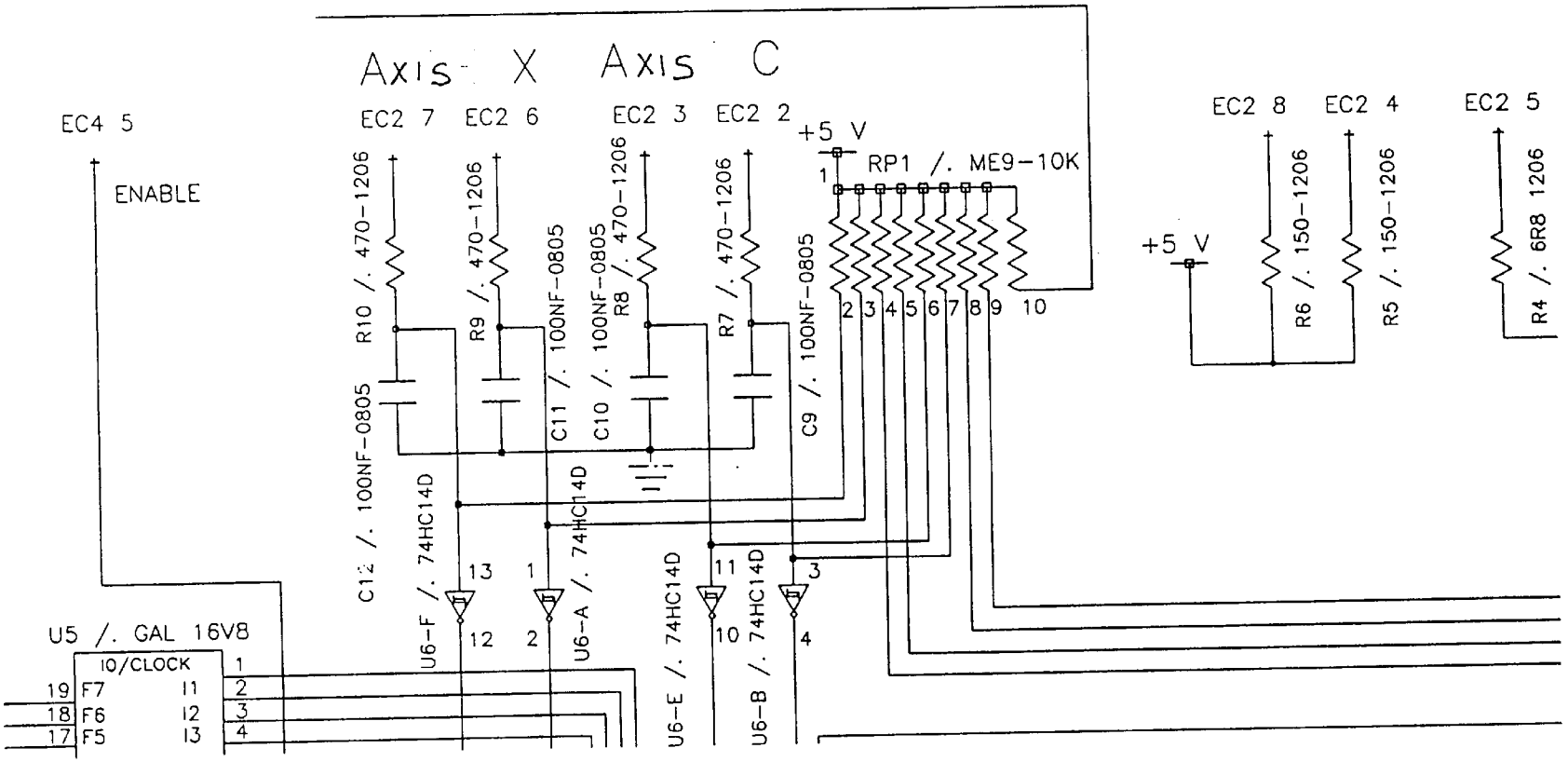
Figure 9C:
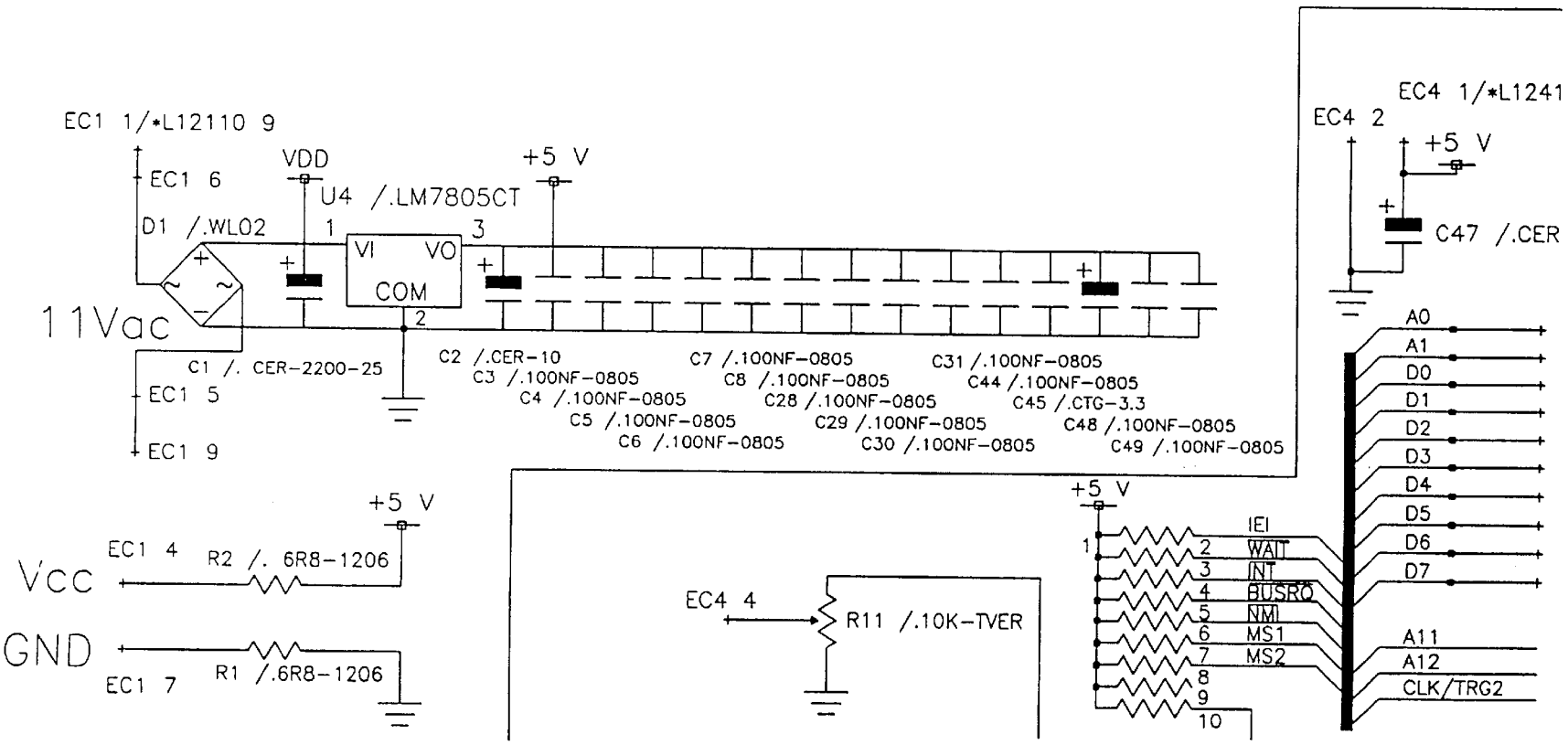
Figure 9D:
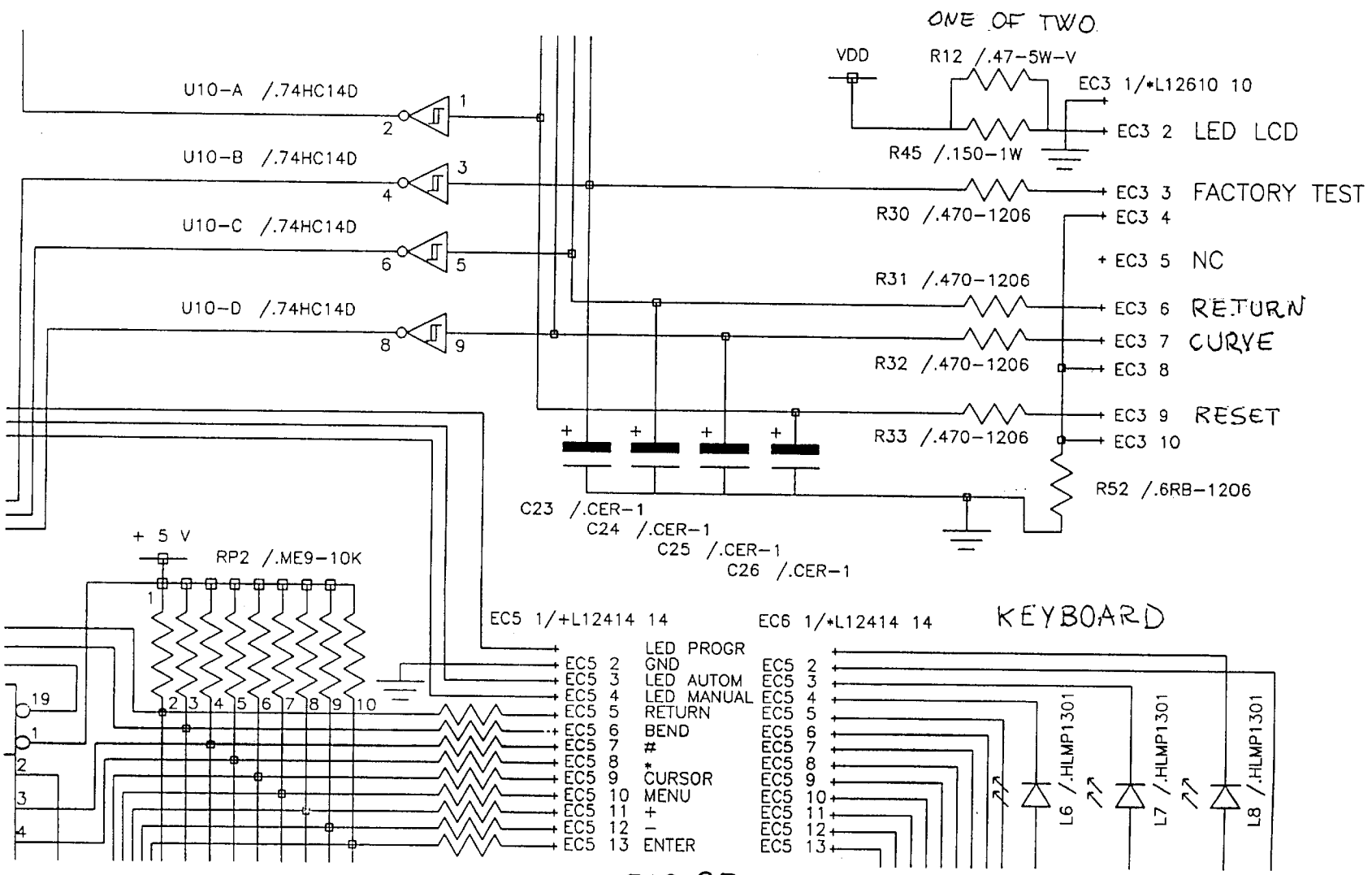
Figure 9E:
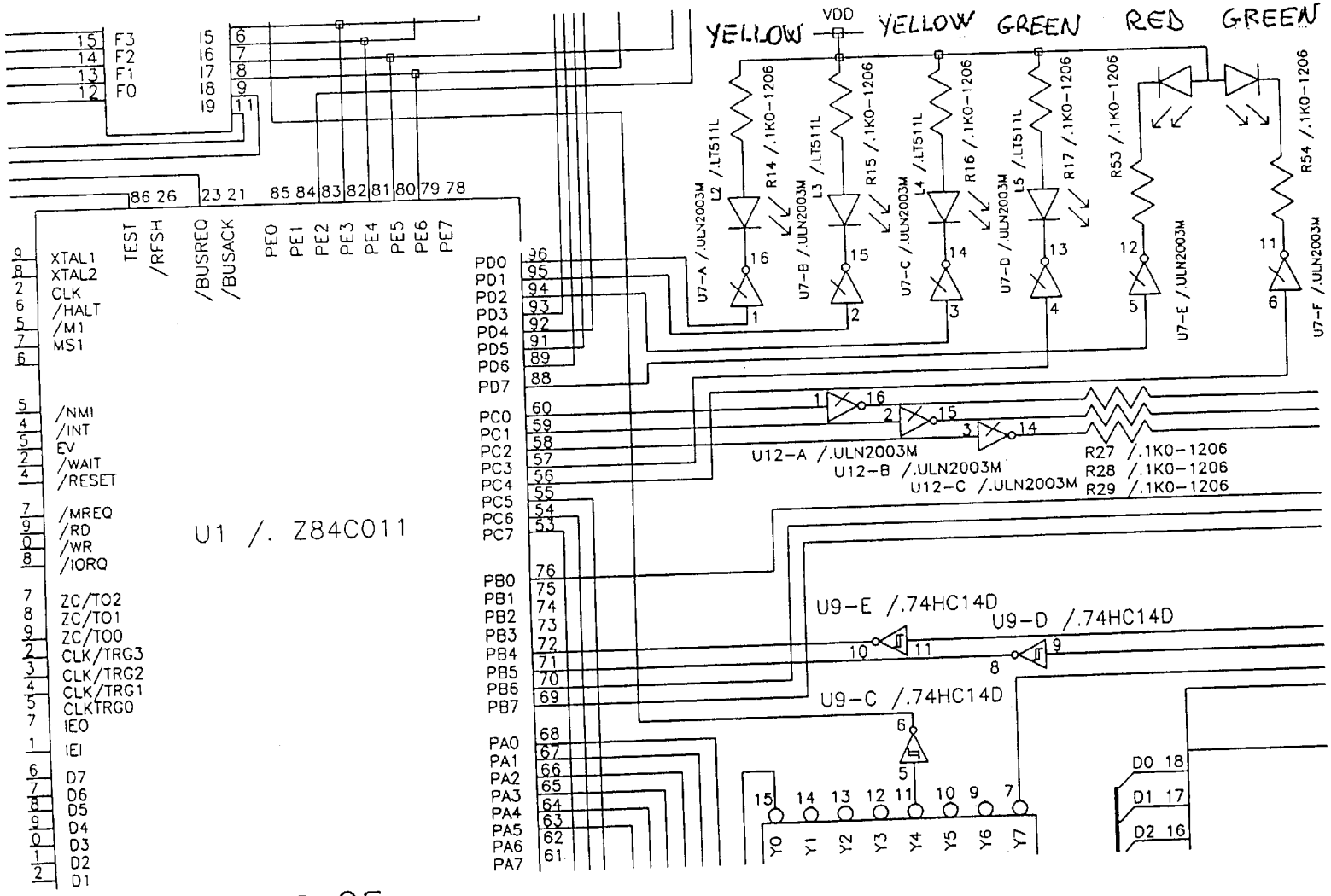
Figure 9F:
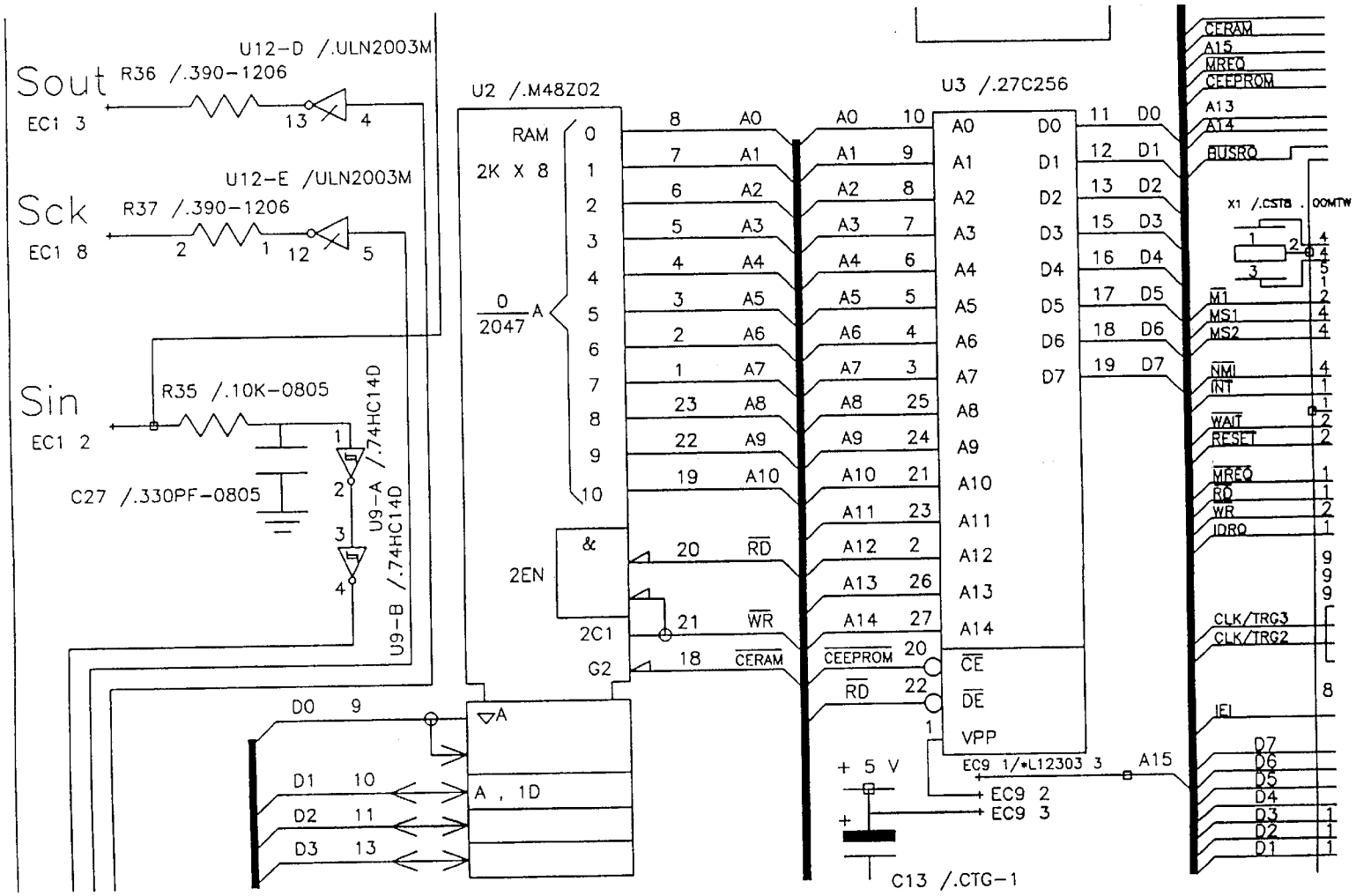
Figure 9G:
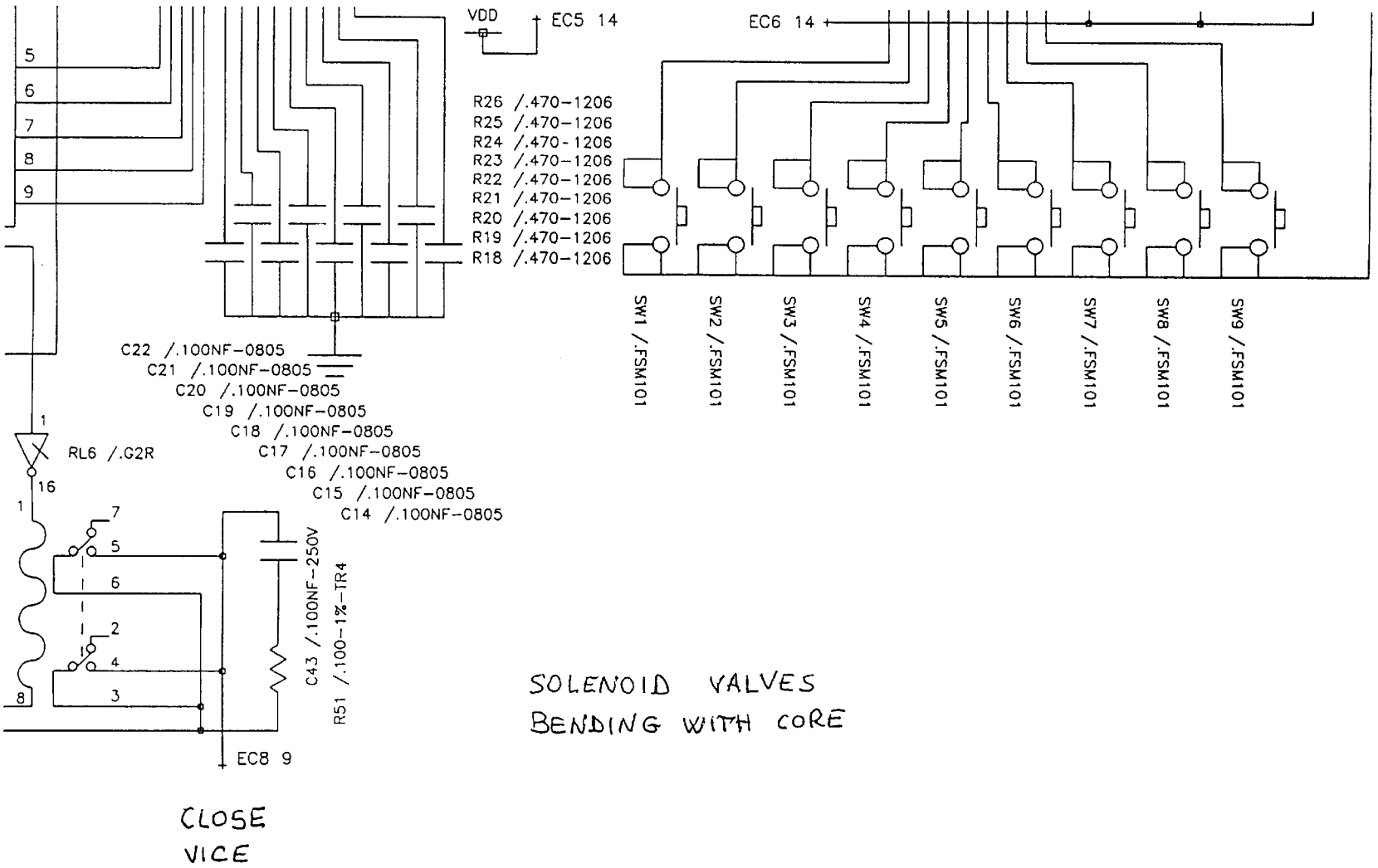
Figure 9H:
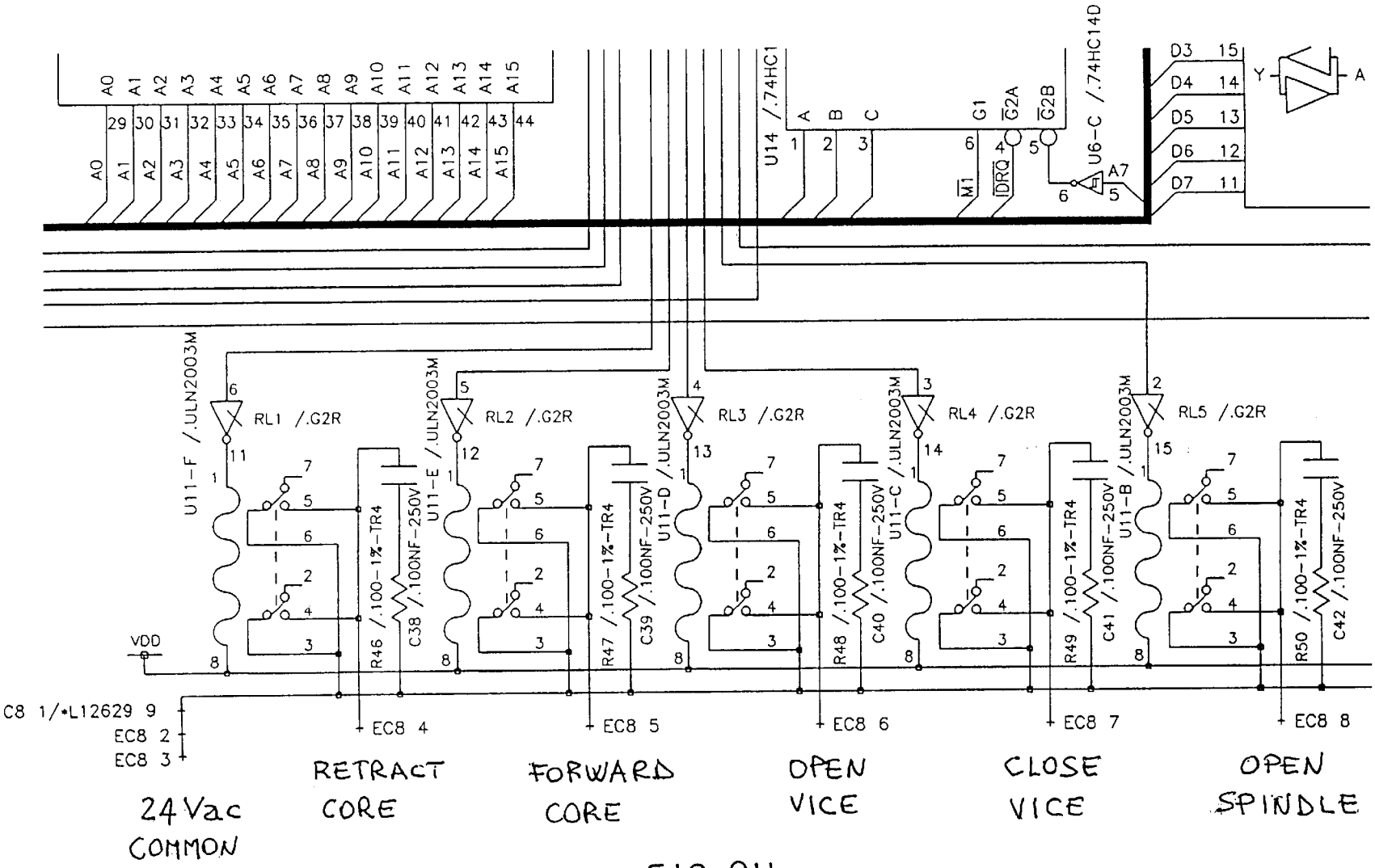
Figure 91:
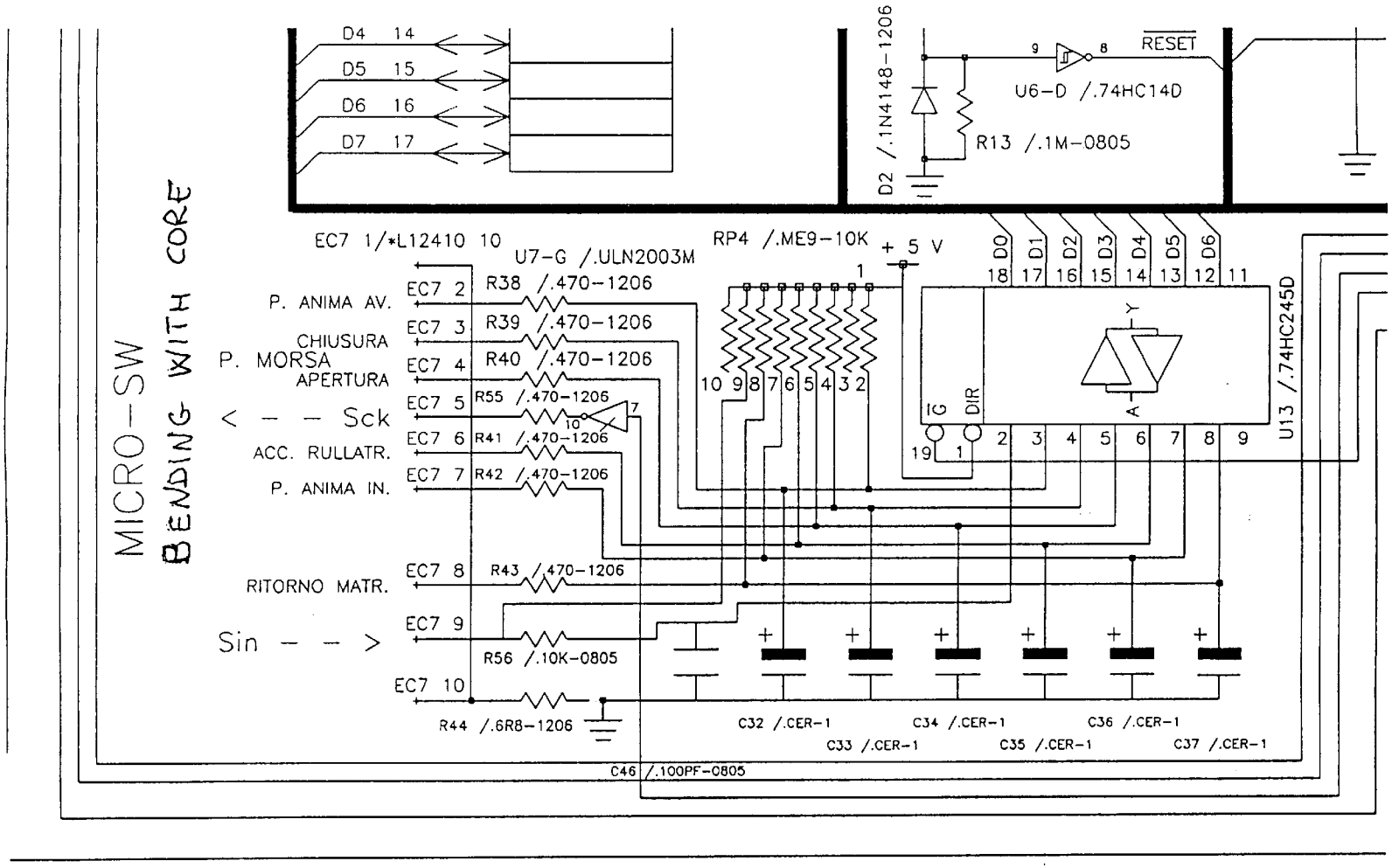

The electronic control system comprises the microprocessing controller 101 and a micro controller inverter 102, as shown in FIG. 7, that are operatively connected by a nine pin connector (male/female) and in communication through a serial interface consisting of two serial units 103, 104. The controller 101 is connected to a keyboard 105 and receives data from an axis X encoder 106 and a curvature encoder 107. The controller 101 is further operatively connected to a reset microswitch 108, two control pedal microswitches 109, a factory test unit 110, a LED unit 111, a microswitch units 112, 112' for bending with core operatively connected together, and a solenoid valve unit 113 for bending with core. The controller 101 drives also a display 114.

The inverter 102, which draws alternating current from a one-phase 110/220 Vac network line, feeds and controls a 220 Vac three-phase motor 116 with a 315 Vdc brake 116'. The inverter 102 controls also an abut microswitch 117 (when operating as a pipe-bender), an emergency microswitch 118 and a limit microswitch 119.

The inverter, on the ground of the programming of the controller 101 and the real situation, can function at set frequency and voltage, with a ramp of acceleration communicated by the microprocessing controller. The inverter as well as the microprocessor can also operate automatically, by changing its frequency and voltage to match an electrical input. This electrical input is set according to a torque required to bend a pipe or section bar being worked, by consequently changing the speed of the motor and then of the pulling spindles, allowing the machine to optimize production cost and time.

The controller tests the line voltage ranging between 200 and 250 Vac, and operates to reduce the motor voltage, so that it is in a range between 195 and 200 Vac for frequencies up to 70 Hz.

This measure makes the system insensitive to line voltage up to 70 Hz, enabling the machine to bend pipes of large diameter in the same way all over the world. For upper frequencies the motor voltage is lightly lower than the line voltage. Thereby, if one has a voltage source near the greatest voltage, he can achieve to bend a same pipe at a higher speed than the one who has a line voltage near the lowest voltage.

Referring now to FIG. 4 a detection device for the control of a bending operation is described. It is an encoder 23 integrally rotating a roller 24 made of an adherent material, such as Vulcolan. The roller 24, that is charged by a spring 25 abutted to the work table 10, is continuously in contact with a pipe or section bar P to be worked. The detection device, removable when desired, is able to detect the longitudinal feeding of the pipe or section bar P. To this aim the detection device is mounted sliding in a straight guide 26' of a shelf 26 that can be fixed to the work table 10 by bolts 27. The encoder 23 with its roller 24 is mounted on a slider 28 charged by the spring 25 abutting against an end of the guide 26'.

The machine can operate as a pipe-bender according to a fixed radius both clockwise and counterclockwise on the spindle noses 12 and 13 respectively as shown in FIG. 5 and FIG. 6. The rotating speed on the spindle nose 12 is double than that on the spindle nose 13, as they are connected by a gear with a transmission ratio of 1:2.

Consequently tha machine according to the invention can bend a pipe or similar in both the right hand and left hand direction;

provides a double rotation speed, allowing a reduction of working time and cost, and further offers the possibility of working at an optimal torque, e.g. at a rotation speed of 0.4 rpm to 6 rpm;

keeps unidirectional the electronic programming of control of the round angle as a pipe-bender to a fixed radius both with a core or without, since its operation clockwise/counterclockwise is obtained merely by mechanical means. This is advantageous because, if one would like to bend a pipe in right hand direction and in left hand direction for example only on the spindle nose 13, he should have both the control electronics and electromechanics bidirectional with a relevant increase of the machine costs (however without the possibility of a double mechanical speed).

In operation the machine displays by means of LEDs the following instructions.

LEDs' MEANING alphanumeric display 20×2: data and message visualization;

WARNING/OVERLOAD LEDs: RED means overload; AMBER means warning; GREEN means free;

SYNCHRONIZATION green LED: flashing means the end of a curve; when continuously lighted it relates to an absolute reference microswitch;

ROLLING yellow LED: the machine works as a ROLLER BENDERS or BENDING MACHINE;

PIPE-BENDER yellow LED: the machine works as a PIPE-BENDER;

MACHINE SPINDLE yellow LED: the machine works as a PIPE-BENDER WITH CORE;

AUTO red LED: automatic control of speed;

PROGR red LED: programming function;

MANUAL red LED: manual control of speed.

The main functions of the keys and the control pedals are as follows:

MAIN FUNCTIONS OF KEYS AND CONTROL PEDALS

OPEN SPINDLE: it opens the spindle or the core (bending with core); *: it enters programming; BLOCK SPINDLE: it blocks the spindle (bending with core); OPEN VICE: it opens the vice (bending with core); RETURN: it moves the axis C (of bending) toward the machine zero point; CLOSE VICE: it closes the vice (bending with core); BEND: it moves the axis C toward the end of the curve; RETRACT SPINDLE: it retracts the core (bending with core); –: it decreases by a unit the number indicated by the flashing cursor; SPINDLE FEEDING: it feeds the core (bending with core); +: it increases by a unit the number indicated by the flashing cursor; MENU: it enters main menu; ENTER: approval of the selected operation; CURSOR: it moves the cursor in various fields.

The microprocessing controller is programmed according to the following software.

SOFTWARE DESCRIPTION

Six bifunctional keys remain active (all or partially) in the function CORE, during all the working cycle (conditions of REST, BENDING, END OF CURVE, IRREVERSIBLE RETURN): OPEN SPINDLE; BLOCK SPINDLE; OPEN VICE; CLOSE VICE; RETRACT CORE; FEED CORE.

The handling of the spindle is not managed in the automatic cycle, and its operativity depends only upon the two bifunctional keys OPEN SPINDLE and BLOCK SPINDLE.

The condition of rest of the PIPE-BENDER is indicated by the following screenful: CONDITION OF REST/APPROACH COUNTERMATRIX/mm–003.7 P.24 090°.

mm–003.7: position of the countermatrix (axis X); P. 24: group 2 curve 4; 090°: set degrees for the indicated curve.

OPERATING MEANS

+: it skips the current curve; ENTER: it resets the position of the countermatrix; CURSOR: it displays the rpm of the current group; rpm 1.53; –: it decreases the rpm; +: it increases the rpm; ENTER: it accepts; MENU: it enters the main menu (condition of programming): MAIN MENU/1-PROGRAMMING (see below); BEND (control pedal or key): if the position of the countermatrix is between mm–000.2 and mm+000.2, the machine starts to bend and it enters the condition of bending.

The condition of rest of the PIPE-BENDER WITH CORE is indicated by the following screenful: CONDITION OF REST/PIPE-BENDER WITH CORE mm 100 P.24 090°.

mm 100: position of the core (0=forward, 100=backward, 50=indefinite); P.24: group 2 curve 4; 090°: set degrees for the indicated curve.

OPERATING MEANS

ENTER: it skips the current curve; CURSOR (less than 0.3 seconds): it displays the rpm of the current group: rpm 1.53; –: it decreases the rpm; +: it increases the rpm; ENTER: it accepts; CURSOR (more than 0.3 seconds): it displays the number of degrees (1–10) before completing a curve, from which the automatic retraction of the core must start:

spindle–7; –: it decreases the degrees; +: it increases the degrees; ENTER: it accepts: MENU: it enters the main menu (condition of programming): MAIN MENU/1-PROGRAMMING (see below); BEND (control pedal): 1—the vice closes, afterward the core proceeds and if the vice is closed, the core is forward and the matrix is back, the core is retracted and then the machine is in the condition of bending; RETURN (control pedal): 1—the core moves back; 2—the vice opens; 3—if the vice is open and the core back, pushing for more than two seconds, the off/on switching of the PROGR LED is performed: when the LED lights, it indicates that the programmed retraction of the core toward the end of the curve is inhibited; it is useful for determining the exact angle of curvature.

PISTON OPERATION (condition of rest)

OPEN SPINDLE: the spindle opens; BLOCK SPINDLE: the spindle blocks; OPEN VICE: the vice opens; CLOSE VICE: the vice closes; RETRACT SPINDLE: the core is retracted; FEED SPINDLE: the core proceeds.

CONDITION OF BENDING

CURVE 24 0° 090° ac 6.3 0° 015°

CURVE 24: selected curve, number 4 of the group 2; 0°: programmed degrees for the recovery of the clearance of the curve 4; 090°: programmed degrees for the curve 4; ac 6.3:

indicator of electrical input; 0°: covered degrees of the recovery of the clearence; 090°: covered degrees of curve.

OPERATING MEANS

ENTER: if the programmed value of the recovery of the clearance is 00° and the covered degrees are less than 45°, the covered degrees are transferred to the programmed degrees of recovery of clearance; CURVE 24 15° 090° ac 6.3 15° 000°; MENU: it display the rpm of the current group; rpm 1.53; −: it decreases the rpm; +: it increases the rpm; ENTER: it accepts; CURSOR: it moves the flashing cursor firstly on the programmed degrees of recovery of clearance and secondly on the programmed degrees of curve, allowing a permanent modification; −: it decreases the degrees; +: it increases the degrees; ENTER: it accepts: it should be noted that the maximum programmable angle is 210°; if this value is surpassed, an operator is informed with a message "TOO GREAT ANGLE"; RETURN (control pedal): it cancels a condition of overload, if any, turning off the WARNING/OVERLOAD red LED.

CURVE (control pedal): 1—the vice closes; 2—if the vice is closed and the core forward, the machine continues to bend until the preset degrees (CONDITION OF THE END OF CURVE) are reached. If the PROGR LED is switched off, at the programmed position (CURVE-spindle), the core or spindle begins automatically to be retracted (the automatic retraction of the core does not take place when the PROGR LED is switched on: this LED can be switched on and off, in the position of rest, by pushing the control pedal RETURN for more than two seconds). In a case of overload (WARNING/OVERLOAD red LED) one can exit acting on the control pedal RETURN: if the manual control speed is selected, the program reduces the rotation speed by 0.1 rpm until a minimum that is not less than 0.66 rpm (with a reduction gear of 1:16.2), allowing a new attempt of bending).

PISTON OPERATION (condition of bending)

OPEN SPINDLE: the spindle opens; BLOCK SPINDLE: the spindle blocks; OPEN VICE: the vice opens; CLOSE VICE: the vice closes; RETRACT SPINDLE: the core is retracted and the program passes to the CONDITION OF IRREVERSIBLE RETURN: RESET AXIS C mm 50 0° 015°; FEED SPINDLE: not active.

CONDITION OF END OF CURVE

CURVE 24 15° 090° mm 50 15° 090°

CURVE 24: selected curve, number 4 of the group 2; 0°: programmed degrees for the recovery of the clearance of the curve 4; 090°: programmed degrees for the curve 4; mm 50: position of the core (0=forward, 100=backward, 50=indefinite); 15°: covered degrees of recovery of clearance; 090°: covered degree of curve; green LED: flashing (SYNCHRONIZATION).

OPERATING MEANS

CURSOR: only in the case in which the core is abutted forward, it moves the flashing cursor firstly on the programmed degrees of recovery of clearance and secondly on the programmed degrees of curve, allowing a permanent modification; −: it decreases the degrees; +: it increases the degrees; ENTER: it accepts: the maximum programmable angle is 210°; if this value is surpassed, the operator is informed with a message "TOO GREAT ANGLE"; if degrees are yet to be covered, i.e. increase of the angle, it returns to the CONDITION OF BENDING; RETURN (control pedal): 1—the core is retracted and the green LED (SYNCHRONIZATION) is switched off, whereupon the vice is open and, if the core is abutted backward and the vice is open, a CONDITION OF IRREVERSIBLE CONTROL is entered: RESET AXIS C mm 50 15° 090°; BENDING (control pedal): 1—the vice closes again.

PISTON OPERATION (condition of bending)

OPEN SPINDLE: the spindle opens; BLOCK SPINDLE: the spindle blocks; OPEN VICE: the vice opens; CLOSE VICE: the vice closes; RETRACT SPINDLE: the core is retracted and the program passes to the CONDITION OF IRREVERSIBLE RETURN: RESET AXIS C mm 50 0° 015°; FEED SPINDLE: not active.

CONDITION OF IRREVERSIBLE RETURN

RESET AXIS C mm 50 15° 090° mm 50: position of the core (0=forward, 100=backward, 50=indefinite); 15°: covered degrees of recovery of clearance; 090°: covered degree of curve.

OPERATING MEANS

RETURN (control pedal): 1—the core moves back; 2—the vice opens; 3—if the vice is open and the core back, the axis C continues to move toward the machine zero point, this condition is reversible only in an overload condition, if any (which can be unblocked, if one acts on the CURVE control pedal); CURVE: in a overload condition, the axis C in moved in CURVE direction by switching of the WARNING/OVERLOAD red LED: RESET AXIS C mm 000.0 15° 086°; when the machine is zeroized, the system checks that also the matrix, the core and the vice are in their condition of rest, indicating what to do: RETURN MATRIX mm 100 P.25 060°. If it does not succeed to bring the machine to its condition of rest (by moving manually the matrix, retracting the core by the RETRACT SPINDLE key and opening the vice by the OPEN SPINDLE key), this can be done pushing at the same time the MENU and CURSOR keys. When the screenful of the condition of rest, however it is advisable to control the functionality of all microswitches of the CORE system by a suitable program (option 8/2).

In normal conditions, by returning manually the matrix, the condition of rest above described is reached: BENDING WITH CORE mm 100 P. 25 060°. It should be noted that the number of curve has been automatically increased, while it would be the same as before if the curve had been interrupted.

PISTON OPERATION (condition of irreversible return) OPEN SPINDLE: the spindle opens; BLOCK SPINDLE: the spindle blocks; OPEN VICE: the vice opens; CLOSE VICE: the vice closes; RETRACT SPINDLE: the core is retracted; FEED SPINDLE: not active.

CONDITION OF PROGRAMMING (main menu)

MAIN MENU 1-PROGRAMMING 2-CONTROL 3-PIPE-BENDER 4-PIPE-BENDER+CORE 5-ROLLER BENDER 6-ORIGIN OF AXIS C 7-SELECT LANGUAGE 8-CHECK SYSTEM EXIT MENU.

PROGR LED: continuously switched on; AUTO LED: switched off. MANUAL LED: switched off.

OPERATING MEANS

+: it displays the next selection; −: it displays the previous selection.

Option 1 CONDITION OF PROGRAMMING (data insertion) with screenful GRP 2 RPM 1.53 SPINDLE−7° where:

GRP: group; RPM: rpr.; SPINDLE: number of degrees (1–10) before completing a curve, from which the automatic retraction of the core must start in order to eliminate the unaesthetic external deformations of the pipe or section bar. The external deformation is produced by the core if the latter, at the end of curve, remains stationary in its work position: if the core is automatically retracted, by synchronizing its movement with that of the matrix, such an anomaly is eliminated (the movements are controlled by the microprocessor); 2: it indicates the group (one of 10 groups, from 0 to 9); 1.53 ring covered in a minute (minimum=0.30; maximum=2.13 with a reduction gear of 16.2:1); −7°: value of degrees (1–10) lacking in completing the curve, from which the automatic retraction of the core must begin.

OPERATING MEANS

*: it increases the number of the group: −: it decreases the number of the group; CURSOR (less than 0.3 seconds): it moves the flashing cursor on RPM, allowing a permanent modification; −: it decreases; +: it increases; ENTER: it accepts; CURSOR (more than 0.3 seconds): it moves the flashing cursor on SPINDLE (core) allowing a permanent modification; −: it decreases; +: it increases; ENTER: it accepts; ENTER: if the indicated group has not programmed curves, it is signalled with "EMPTY GROUP", otherwise it accepts the displayed selection and returns to the condition of rest with screenful PIPE-BENDER WITH CORE mm, 100 P.21 120°; *: by pushing it for three seconds, the screenful of programming of the angles of the 9 curves of the group is entered: GRP 2 ANGLE 000° CURVE 1; +: it increases with repetition; −: it decreases; ENTER: it stores and shows the next curve; by pushing when the angle is 000°, then END OF INSERTION is signalled and returns to initial screenful: END OF INSERTION 2 000° 2, and after 2 seconds: GRP 2 RPM 1.53 SPINDLE−7.

Option 2 CONDITION OF PROGRAMMING (speed control): screenful 2-AUTO-MAN SPEED CONTROL, wherein AUTO: automatic matching of the speed of rotation to pipe sizes: MAN: the speed of rotation is a set speed for the selected group.

OPERATING MEANS

+: AUTO/MANUAL switching; ENTER: it accepts the displayed selection and returns to the condition of rest with the screenful: PIPE-BENDER WITH CORE mm 100 P. 24 090°. The AUTO and MANUAL LEDs indicate the selection made.

Option 3 CONDITION OF PROGRAMMING (selection of the functions) with screenful: MAIN MENU 3-PIPE-BENDER.

OPERATING MEANS

ENTER: it accepts the displayed selection and returns to the condition of rest with the screenful: APPROACH COUNTERMATRIX mm 000.0 P. 24 090° only if there are not attachments such as a system with core or bending machine. The PIPE-BENDER yellow LED indicates that the selected function has been accepted.

When an attachment is present, the following screenful is shown:

NOT AVAILABLE 3-PIPE-BENDER and after 2 seconds: MAIN MENU 3-PIPE-BENDER.

Option 4 CONDITION OF PROGRAMMING (selection of the functions) with the screenful MAIN MENU 4-PIPE-BENDER+CORE.

OPERATING MEANS

ENTER: the system asks the access code to the function PIPE-BENDER WITH CORE with the screenful: digitize ACCESS-CONTROL WORD; a symbol corresponds to each of the seven keys used: * : *; # : #; RETURN: R; CURVE: B; − : −; +: +; ENTER: it analyses the digitized sequence, if it corresponds to the access code, then it accepts the function PIPE-BENDER WITH CORE and goes to the condition of REST (PIPE-BENDER WITH CORE) with the following screenful: PIPE-BENDER WITH CORE mm Q100 P. 24 090°. The MACHINE SPINDLE yellow LED indicates that the function has been accepted; MENU: it permits to return to MAIN MENU in CONDITION OF REST (PIPE-BENDER): PIPE-BENDER WITH CORE mm 100 P. 24 090°.

Option 5 CONDITION OF PROGRAMMING (selection of the functions): screenful MAIN MENU 5-ROLLER BENDER; ENTER: the system asks the access code to the function ROLLER BENDER: digitize ACCESS-CONTROL WORD; a symbol corresponds to each of the seven keys used: * : *; # : #; RETURN: R; CURVE: B; − : −; + : +, ENTER: it analyses the digitized sequence, if it corresponds to the access code, then it accepts the function ROLLER BENDER, advising to fit the attachment if this is not yet present. In CONDITION OF REST (ROLLER BENDER), ROLLER BENDER mm +0000,1 is displayed; MENU: it permits to return to the CONDITION OF REST (PIPE-BENDER): APPROACH COUNTERMATRIX mm 000.0 P. 24 090°.

Referring to FIG. 4 and description thereto, the program controls at the same time both the position of the bender roller by the hydraulic piston 14*b* and the feeding of the pipe by means of the encoder 23. This permits the construction of geometrical figures on a pipe or section bar, that are made of arches and straight lines, automatically without removing the pipe or section bar. If the encoder 23 is excluded, the system exits automatically from this function to return to the condition of rest PIPE-BENDER, through the machine zero point (origin of axis C).

Option 6 CONDITION OF PROGRAMMING (machine zero point) with screenful MAIN MENU 6-ORIGIN OF AXIS C; ENTER: it accepts the displayed selection and control that the matrix, the core and the vice are in their condition of rest, indicating what to do: OPEN VICE mm 100, wherein mm 100 is the position of the core (0=forward, 100=backward, 50=indefinite). If one is not able to bring the machine to its condition of rest (by manually moving the matrix, retracting the core by the key RETRACT SPINDLE and opening the vice by the key OPEN VICE) he can do that pushing at the same time the keys MENU and CURSOR; when the next screenful appears, however it is advisable to go to option 8/2 in order to check the functionality of all microswitches of the system CORE. In normal conditions, by manually moving back the matrix, it enters the programming of the MACHINE ZERO POINT: ORIGIN OF AXIS C.

OPERATING MEANS

RETURN (control pedal or key): the axis C moves clockwise; CURVE (control pedal or key): the axis C moves counterclockwise; ENTER: it accepts the position reached as MACHINE ZERO POINT and returns to the CONDITION OF REST: PIPE-BENDER WITH CORE mm 100 P. 24 090°.

Option 7 CONDITION OF PROGRAMMING (selection of language) with screenful: MAIN MENU 7-SELECTION OF LANGUAGE; ENTER: it accepts the displayed selection; it compares the screenful CHOOSE YOUR LANGUAGE/ITALIAN/ENGLISH/DEUTSCH/ . . .

OPERATING MEANS

+: it displayes the next language; ENTER: it accepts the displayed selection and returns to the CONDITION OF REST with screenful: PIPE-BENDER WITH CORE m 100 P. 24 090°; the display will show all messages in the new selected language.

Option 8 CONDITION OF PROGRAMMING (machine test) with a screenful: MAIN MENU 8-SYSTEM CHECKING; the system asks the access code to the function of SYSTEM CHECKING by displaying the message DIGITIZE ACCESS-CONTROL WORD; a symbol corresponds to each of the seven keys used: * : *; # : #; RETURN: R; CURVE: B; – : –; CURSOR: CORE C; + : +; ENTER: it analyses the digitized sequence, if it corresponds to the access code, then it accepts the function SYSTEM CHECKING, showing its submenu: FUNCTION CHECKING 1-KEYS AND CONTROL PEDALS 2-ENTRANCE SIGNALS 3-OPERATION TEST 4-DYNAMIC CONTROL 5-SYSTEM RELEASE; MENU EXIT.

OPERATING MEANS

+: it displayes the next selection; –: it displayes the prior selection; ENTER: it accepts the displayed selection.

Option 8/1 KEYS AND CONTROL PEDALS CHECKING (machine test) with the screenful: FUNCTION CHECKING 1-KEYS AND CONTROL PEDALS/ENTER/ 1-KEYS AND CONTROL PEDALS.

OPERATING MEANS

By pushing one at a time the eight keys (the key MENU works for returning to submenu) and the two control pedals, their denominations will appear on the second line of the display: 1-KEYS AND CONTROL PEDALS/#/RETURN/ ENTER/CURVE/–/CURSOR/+;

MENU: it returns to the submenu of FUNCTION CHECKING: FUNCTION CHECKING 1-KEYS AND CONTROL PEDALS.

Option 8/2 ENTRANCE SIGNAL CHECKING (machine test) with the screenful: function checking 2-ENTRANCE SIGNALS/ENTER/2-ENTRANCE SIGNALS.

OPERATING MEANS

By operating one at a time the nine microswitches, their denominations will appear on the second line of the display:

2-ENTRANCE SIGNALS

Limit RETURN
Limit CURVE
SYNCHRONISM
CORE FORWARD
CLOSED VICE
OPEN VICE
MATRIX RETURN
CORE BACKWARD
ROLLER BENDER ATTACHMENT;

CURSOR: it displayes the line voltage, the microswitches can be monitored again by the same key; 2-ENTRANCE SIGNALS 218 Vac;

MENU: it returns to FUNCTIONS CHECKING submenu: FUNCTION CHECKING 2-ENTRANCE SIGNALS.

Option 8/3 OPERATION TEST (machine test) with the screenful: FUNCTION CHECKING 3-OPERATION TEST, ENTER; 3-OPERATION TEST.

OPERATING MEANS

By operating one at a time the six bifunctional keys, the respective piston is operated as indicated in the second line of the display:

3-TEST OPERATIONS/OPEN SPINDLE/BLOCK SPINDLE/OPEN VICE/OPEN VICE/CLOSE VICE/ RETRACT CORE/FEED CORE; MENU: it returns to FUNCTION CHECKING submenu: FUNCTION CHECKING 3-OPERATION TEST.

Option 8/4 DYNAMIC CONTROL (machine test)

The purpose of this option is to individuate the position of the three operating microswitches (two limit microswitches and one absolute reference microswitch) and the adjustment of the axis C encoder. The message REMOVE MATRIX appears, it returns from MENU to submenu and, by pushing ENTER, the screenful RET CURVE SYNCHRO ENC; RET: limit microswitch RETURN; CURVE: limit microswitch CURVE; SYNCHRO: absolute reference microswitch (synchronism); ENC: axis C encoder.

OPERATION MEANS

CURVE (control pedal or key): the axis C rotates in a curve direction until it reaches the limit microswitch CURVE; it checks the adjustment of the axis C encoder every 2.5 seconds (acceptable values: $-15 \leqq ENC \leqq +15$); the second line of the display shows the current position of the limit microswitch CURVE (the reversal of the rotating direction is inhibited until the limit microswitch CURVE is reached): RET CURVE 206° SYNCHRO ENC +10;

RETURN (control pedal or key): the axis C rotates in the direction of RETURN until the limit microswitch RETURN is reached. The second line of the display shows the current position of the microswitches RETURN and SYNCHRO as well as the absolute position of the microswitch CURVE (the reversal of the rotating direction is inhibited until the limit microswitch is reached): RET –003° CURVE 206° SYNCHRO 004° ENC +10; CURVE (control pedal or key): the axis C rotates in CURVE direction until the preset machine zero point (origin) is reached; the screenful RET +003° CURVE 206° SYNCHRO 004° ENC +10 shows the position of the three microswitches with respect to the machine zero point (axis C origin); it is necessary that the synchronism microswitch is in a position between +2° and +100° ($+2° < \text{synchro} \leqq +100°$); MENU returns to the function checking submenu: FUNCTION CHECKING 4-DYNAMIC CONTROL. If the machine is switch off in any point before the end of the sequence, the system, by displaying AXIS C ORIGIN, obliges the operator to zeroize again the machine.

The present invention has been described and shown in relation to its specific embodiments, but it must be intended that modifications, additions and/or omissions can be apported, without departing from the teachings originally proposed. Thus, the matter for which protection is sought is defined by the enclosed claims.

What is claimed is:

1. Machine for bending pipes or section bars comprising a work table on which two or more powered spindle noses appear, at least one of which is powered to rotate in a direction and at least another is idle or driven to rotate in the opposite direction to the former one; said spindle noses being accessible for mounting/demounting on/from them spindles designed to support respective bender rollers or matrices defining a work area on the work table in order to bend a pipe or a section bar according to fixed or variable radiuses; and support means for a counteracting member designed to co-operate with said bender rollers or matrices in a bending operation according to fixed or variable radiuses; said support means being firmly locatable on straight guide means in said work table along an approachment/removal direction of said counteracting member to/from said work area, wherein said support means for a counteracting member comprises a slider firmly locatable along said guide, and a bracket provided with mounting means of a bender roller in an adjustable position transversally to the movement of the slider along the guide thereof.

2. Machine for bending pipes or section bars according to claim 1, wherein said mounting means of a bender roller on said bracket comprises a plurality of holes obtained in the same bracket along a line transversal to the movements of approachment/removal to/from the work area of said slider.

3. Machine for bending pipes or section bars according to claim 1, further characterized in that said bracket is mounted swinging on said slider; its swing being controlled by a lever arm pivoted toward an end thereof on the same bracket, and by means of its opposite end on the work table, in order to change continuously a distance between the axes of the bender roller mounted on the bracket and a roller mounted on a sprindle nose, that in a bending operation is internal to a pipe c section bar to be worked, the bender roller mounted on the bracket being external.

4. Machine for bending pipes or section bars according to claim 3, wherein said lever arm has a number of holes toward an end thereof for its pivoting with said bracket.

5. Machine for bending pipes or section bars according to claim 3, wherein said lever arm has a slot toward an end thereof for its pivoting with said bracket with a micrometer adjustment of the positioning.

6. Machine for bending pipes or section bars comprising a work table on which two or more powered spindle noses appear, at least one of which is powered to rotate in a direction and at least another is idle or driven to rotate in the opposite direction to the former one; said spindle noses being accessible for mounting/demounting on/from them spindles designed to support respective bender rollers or matrices defining a work area on the work table in order to bend a pipe or a section bar according to fixed or variable radiuses;

support means for a counteracting member designed to co-operate with said bender rollers or matrices in a bending operation according to fixed or variable radiuses; said support means being firmly locatable on straight guide means in said work table alone an approachment/removal direction of said counteracting member to/from said work area; and support means of a pressure roll, that is pivoted about an axis of rotation of a bender roller mounted on a spindle nose that, in a bending operation of a pipe or section bar is internal to the latter; a bender roller mounted on said support means for a counteracting member being external, the pipe or section bar reaching said pressure roller from the guide of these two bender rollers; and said support means of pressure roll being pivoted to a bracket by a small arm including adjustable pivoting means along a length dimension thereof.

7. Machine for bending pipes or section bars according to claim 6, wherein said support means of a pressure roll includes adjustable pivoting means along a direction parallel to the axis of a pressure roll mounted thereon by said small arm.

8. Machine for bending pipes or section bars according to claim 6, wherein said adjustable pivoting means is a line of holes.

9. Machine for bending pipes or section bars comprising a work table on which two or more powered spindle noses appear, at least one of which is powered to rotate in a direction and at least another is idle or driven to rotate in the opposite direction to the former one; said spindle noses being accessible for mounting/demounting on/from them spindles designed to support respective bender rollers or matrices defining a work area on the work table in order to bend a pipe or a section bar according to fixed or variable radiuses;

support means for a counteracting member designed to co-operate with said bender rollers or matrices in a bending operation according to fixed or variable radiuses; said support means being firmly locatable on straight guide means in said work table along an approachment/removal direction of said counteracting member to/from said work area; and an electric motor to power said spindle noses; an operating cylinder to approach/remove said support means of counteracting member, and an electric motor to operate said cylinder.

10. Machine for bending pipes or section bars according to claim 9, further comprising a microprocessing control unit operatively connected to said electrical motors; an inverter operatively connected to said electrical rotor and to a power source as well as to said microprocessing control unit; a control keyboard blanked to said control unit; a display blanked to said control unit; detecting and encoding means of the position of said support means of counteracting member and detecting and encoding means of the angular position and the rotation speed of at least a spindle nose, said microprocessing control unit being programmed to control a bending operation of a pipe or section bar according to a fixed radius or a variable radius through the control of said spindle noses and said cylinder.

11. Machine for bending pipes or section bars according to claim 10, wherein said microprocessing control unit is programmed to control automatically through said inverter the rotation speed of said electric motor powering said spindle noses and said bender rollers according to a torque required to bend a pipe or section bar, optimizing working cost and time.

12. Machine for bending pipes or section bars according to claim 10, further comprising detecting means of the longitudinal feeding of a pipe or section bar in a bending operation, said microprocessing control unit being programmed to control both the linear position of a third deformation roller—which is mounted as a counteracting member on said support means of counteracting member for a bending operation—by means of said cylinder and the feeding of the pipe or section bar, thus permitting the construction of geometrical figures formed by arches and straight lines automatically without removing the pipe or section bar.

13. Machine for bending pipes or section bars according to claim 10, wherein said microprocessing control unit tests the network line voltage for the spindle nose motor, adjusting the voltage on the electrical motor so that it is between 195 and 200 Vac.

* * * * *